United States Patent [19]

Cyphert et al.

[11] Patent Number: 4,985,715

[45] Date of Patent: Jan. 15, 1991

[54] MARKER ASSEMBLY FOR SPRAY MARKING DOT MATRIX CHARACTERS AND METHOD OF FABRICATION THEREOF

[75] Inventors: David L. Cyphert, Canal Winchester; John A. Robertson, Chillicothe, both of Ohio

[73] Assignee: Telesis Controls Corporation, Chillicothe, Ohio

[21] Appl. No.: 497,507

[22] Filed: Mar. 22, 1990

[51] Int. Cl.[5] ..... B41J 2/07

[52] U.S. Cl. ..... 346/140 R; 361/152

[58] Field of Search ..... 346/140, 75; 361/160, 361/171, 187, 152

[56] References Cited

U.S. PATENT DOCUMENTS

| | | | |
|---|---|---|---|
| 4,350,319 | 9/1982 | Kawata et al. | 361/152 |
| 4,819,009 | 4/1989 | Kniepkamp | 346/140 |
| 4,875,058 | 10/1989 | Vonasek | 346/140 |
| 4,878,147 | 10/1989 | Oyama et al. | 361/187 |

*Primary Examiner*—Joseph W. Hartary
*Assistant Examiner*—Alrick Bobb
*Attorney, Agent, or Firm*—Mueller and Smith

[57] ABSTRACT

A linear array of solenoid actuated marker valve assemblies is contained in a housing configured as a manifold which carries marker fluid as well as nebulizing air supplies and a solvent distributing valve for use in clearing the air passages. All valve assemblies are accessible from the front surface of the device for ease of maintenance and are assembled in a manner assuring uniform and consistent valve stem travel advantageously eliminating the need for valve stem travel adjustment. The control system utilized with the valve assemblies provides both for an enhanced current input rate to the windings of the solenoid driven components, as well as an efficient and effective turn-off clamping procedure. This form of actuation of the solenoids achieves dynamically efficient and rapid turn-off and turn-on to the extent that the size of dots formed by the assembly can be provided having a broader range of diameters and these diameters can be adjusted remotely by a simple impedance variation. The features of the invention permit the application of characters at substantially enhanced production line speeds.

34 Claims, 9 Drawing Sheets

300
302
LOGIC CONTROL
304
306
332
336
330
334
328
310
308
312
314
316
318
320
322
324
326
356
+5V
R3
R4
R5
R6
R7
R8
R9
R10
R11
R1
R2
C1
D1
D2
358
360
354
+12V
352a
352b
352c
352d
352e
352f
352g
352h
336a
336b
336c
336d
336e
336f
336g
336h
TO FIG. 10B
D3
D7
D2
D6
D1
D5
D0
D4
A7
A6
A5
A4
A3
A2
A1
A0
CUR
TORQ
8D Q8
1D Q1
CK
OE
E3 Y7
E1
A2
A0 Y0
T1
T2
A
B
Q
Q̄
CD 340
349
348
347
346
345
344
343
342a
POWER SOURCE
370
372
WINDINGS
374
388
FROM FIG.10A
+12V
+1.25V
390
392
394
400
402
404
396
384
Q1
F1
R12
R13
R16
R17
R18
R19
R20
R21
C2
C3
C4
C5
C6
C7
D3
D4

LOGIC CONTROL
TO FIG. 13B
SYSRES
WR
IORQ
+5V
R30
R31
R32
J1
J2
C10
C11
D20
D21

24V
0V
-48V 514
450
554
523
522
521
520
519
518
517
532h
528h
512h
532g
528g
512g
532f
528f
512f
532e
528e
512e
532d
528d
512d
532c
528c
512c
532b
528b
512b
532a
528a
512a
FROM FIG.13A
538h
556
538g
538f
538d
538e
538c
538a
538b
D23
C13
R38
538
540
-48V
SOL 8
SOL 1
COMMON
COMMON
+24V
+24V
58a'
558
F2
516
+12V
D22
R39
D24
536
Q3
Q4
R33
R37
R36
548
550
552
546
544
542
R34
R35
C12
+5V
+12V
530
533
534
D25
R40

MARKER ASSEMBLY FOR SPRAY MARKING DOT MATRIX CHARACTERS AND METHOD OF FABRICATION THEREOF

BACKGROUND OF THE INVENTION

A widely employed industrial identification or marking technology involves the formation of characters or symbols in dot matrix fashion using discrete jets of marker fluid or ink. Conventionally, this marker ink is expressed from select ones of a linear array of nozzles in conjunction with nebulizing air to form dots at the workpiece to be marked. Such fluid expression usually is controlled by a valve needle or stem which opens from a spring biased closed position under the drive of an energized solenoid. This drive pulls the stem point or terminus an adjusted distance from a valve seat. The distance between the valve pin or stem terminus or tip and the valve seat with which it cooperates typically has been in the range of 0.002 to 0.045 inch. Because of the inductive nature of solenoid drives, this opening movement of the valve pin develops at slower rates pending current build-up in the excitation coil of the drive device. Conversely, upon turning off current to the solenoid device excitation winding, it is desirable to control the resultant inductive "spike" typically encountered. Unfortunately, such control makes it more difficult to deactivate the winding for closing purposes resulting in slower or more inefficient valve operation. Thus adjustments for dot size generally have been restricted to procedures wherein control is exerted over the extent of needle travel. Such a limited form of control has resulted in constraints over the size range of dots available to the user, smaller diameter dot imprints being difficult to achieve. Further, past performance of the solenoid actuated valves used with these devices has imposed constraints on the throughput rate or line speeds acceptable for marking device requirements.

In general, the valve stem travel is determined by the distance between the rearwardly facing surface of an armature attached with the stem and a pole piece resident within the solenoid structure. Adjustment in the field is somewhat burdensome. In this regard, the devices are taken off line and mechanical adjustments are made in combination with test procedures, whereupon the assembly is remounted at the production line.

The extent of maintenance required for the marking devices at hand depends, in part, on the environment of their use, which varies from somewhat benign to quite harsh. For instance, some applications call for the marking of nascent metal components having surface temperatures of about 1800° F. Typically, highly alkaline inks formed with ceramic particle suspensions are employed for such hot environments. The sticking of valve needles or stems has been somewhat common with such hot environment systems. The environments within which the markers are employed also pose difficulties to the designer in terms of the structuring and containment of their electrical control and drive systems. In this regard, it is necessary that spark potential be eliminated which, in turn, calls for the control and minimization of terminals and the like as well as a highly reliable form of power supply and control packaging.

SUMMARY

The present invention is addressed to an improved marker assembly and method of fabrication thereof which are employed for spray marking surfaces with a marking fluid. The apparatus is fabricated as a compact, lightweight assembly suiting it for use in a broadened variety of industrial applications, for example, those calling for robot manipulation. Solenoid driven valve assemblies are integrally formed within the apparatus and are accessed by maintenance personnel from the forward face of the assemblies for ink valve needle and valve seat cleaning and replacement. On the other hand, access to electrical components and associated wiring or cabling is conveniently made from the opposite region of the assembly. Because of a unique compartmentalization of the electrical input to the solenoid valve excitation windings integrally incorporated therewithin, the apparatus may be used in more hazardous industrial environments where spark avoidance is mandated.

The marking apparatus of the invention is primarily employed in the formation of dot matrix defined characters. Under the method devised for its fabrication, tolerances are uniformly and readily achieved so as to develop an operationally precise and uniform control over the extent of travel of the pin or valve stem assembly within each valve component. This feature not only achieves the important advantage of essentially eliminating otherwise required on-site valve adjustments to maintain dot size, but also enhances the performance of a highly desirable dot size adjustment approach. Through the addition of a highly efficient dynamic performance aspect to the solenoid valves, dot size can be adjusted electrically by the operator from a remote location and marking speeds may be increased significantly. These combined aspects of uniform performance and efficient solenoid excitation coil actuation serve to expand the range of dot sizes available to the system to smaller diameters. Further, the quality of the dots so formed to provide matrix characters is substantially improved and line speed performance is significantly improved.

Another feature of the invention is the provision of a marker assembly which is actuable for spray marking a surface with marking fluid which comprises a housing extending from a front surface to a rearward portion. A channel is formed within the housing having a given axis and extending from the front surface to the rearward portion and a sleeve is fixed within the channel and extends into the rearward portion. An excitation coil is positioned over the sleeve at the rearward portion and a pole piece is fixed within the sleeve and within the excitation coil which has a forward surface located a predetermined distance from the housing front surface. A fluid cap is removably mounted upon the housing front surface and has a passageway coaxial with the given axis which extends to an opening within a valve seat. A valve stem having a tip seatable in closing relationship against the valve seat is provided, the stem being reciprocally movable and extending within a channel and the sleeve to an armature retaining portion. A spring within a channel biases the valve stem into the noted closing relationship. An armature is fixed to the valve stem armature retaining portion which is slideably movable therewith within the sleeve and has a rearwardly disposed surface positioned a predetermined fixed gap distance from the pole piece forward surface when the valve stem is positioned in the closing relationship. A fluid input is provided for supplying the fluid to the chamber and a control arrangement is provided for selectively energizing the excitation coil to effect retraction of the armature to the extent of the noted fixed gap.

As another feature, the invention provides a method for forming a marker assembly for spray marking a surface with a working fluid which comprises the step of:

providing a housing extending from a front surface representing a first datum plane to a rearward portion;

forming a channel within the housing extending normally from the front surface;

providing a pole piece having a forward surface representing a second datum plane;

fixing the pole piece within the channel at the housing rearward portion at a location wherein the second datum plane is a fixed, predetermined distance from the first datum plane;

providing an excitation winding;

mounting the excitation winding upon the housing over and in magnetic flux transfer assocation with the pole piece;

providing a fluid cap threadably mountable upon the housing in seated relationship at the front surface in operative communication and alignment with the channel, the cap having a passageway extending to an opening located at a valve seat;

providing a valve stem having a tip seatable in closing relationship against the valve seat and extending to an armature retaining portion;

providing an armature configured for slideable movement within the channel having a rearwardly disposed surface and an oppositely disposed receiving portion for receiving the valve stem retaining portion;

providing a stem assembly jig having a cap mounting surface representing a third datum plane corresponding with the first datum plane and having an opening extending therethrough for removably receiving the fluid cap in seated relationship and having a locator component including a reference surface representing a fourth datum plane aligned with and spaced from the third datum plane a mounting distance representing the distance between the first datum plane and the second datum plane less a predetermined gap distance;

mounting the fluid cap upon the assembly jig opening in seated relationship with the cap mounting surface;

positioning the valve stem tip in the closing relationship against the valve seat;

inserting the armature retaining portion of the valve stem within the armature receiving portion;

positioning the armature rearwardly disposed surface against the locator component reference surface;

then fixing the armature retaining portion of the valve stem to the armature receiving portion of the armature while positioned within the stem assembly jig to provide a valve stem-armature assembly;

providing a spring for biasing the valve stem tip into seated closing engagement with the valve seat;

inserting the spring and the valve stem-armature assembly within the channel; and mounting the fluid cap in seating relationship upon the housing at the first surface in operative communication and alignment with the channel.

Another feature of the invention provides a control system for carrying out the energization of the excitation winding of a solenoid driven valve, actuable between on and off states to effect a dot image forming dispersion of marker fluid in accordance with logic inputs. The system includes a receiving arrangement for receiving the logic inputs and having a corresponding actuation output for a duration which is selectable by the activation thereof. A timer responds to the logic inputs and derives a receiving arrangement activation for a selectively adjustable interval of time, and a source of power having a voltage level selected as effective to enhance the rate of current development within the excitation winding is provided to derive an efficient on-state actuation of the valve. A first solid-state power switch is connectable in current switching relationship between the source of power and the excitation winding which is responsive to a switch input to derive a conductive state effecting the application of the source of power to the excitation winding and responsive to the removal of the switch input to terminate the application. A current control network, coupled with the solid-state power switch and responsive to the actuation output to have an on-state is provided. The control network derives the gate input during an on-state and includes a current monitor network for effecting the gate input removal during the on-state when the current development within the excitation winding exceeds a predetermined value. The control network responds to the removal of the actuation output to remove the switch input and assume an off-state.

Another feature of the invention provides a driver circuit for carrying out the energization of the excitation winding of a solenoid actuated valve in response to an actuation output, which comprises a source of power having a voltage level selected as effective to enhance the rate of current development within the excitation winding. A solid-state switch is connectable in current switching relationship between the source of power and the excitation winding and is responsive to a switch input to derive a conductive state effecting the application of the source of power to the excitation winding and responsive to the removal of the switch input to terminate the application of the source of power. A current control network is provided which is coupled with the solid-state switch and is responsive to the actuation output to have an on-state, the control network deriving the switch input during the on-state, including a current monitor network for effecting the switch input removal during the on-state when the current development within the excitation winding exceeds a predetermined value, and including a regeneration network for effecting the rederivation of the switch input during the on-state when the current development returns to a value below the predetermined value, the control network being responsive to removal of the actuation output to remove the switch input to assume an off state.

Another feature of the invention provides a driver circuit for carrying out the energization of the excitation winding of the solenoid actuated valve in response to an actuation output. The circuit comprises a first source of power having a voltage level of first polarity selected as effective to enhance the rate of current development within the excitation winding and a second source of power having a voltage level less than that of the first source of power and which is of second polarity. A first solid-state switch, actuable between on and off states is provided for applying the first source of power across the winding and a second solid-state switch is actuable between off and on states for applying the second source of power across the winding. A control arrangement responds to the actuation output for simultaneously actuating the first and second solid-state switches to the on state and subsequently actuates the first solid-state switch to its off state following an interval selected for enhancing the rate of current build-up within the excitation winding.

Another feature of the invention provides a control system for carrying out the energization of the excitation winding of a solenoid-driven valve, actuable between on and off states to effect a dot image forming dispersion of marker fluid in accordance with logic inputs. The system includes an input arrangement which is responsive to the logic inputs for providing an activation output for a predetermined interval. A first source of power is provided having a voltage level of first polarity selected as effective to enhance the rate of current development within the excitation winding to derive an efficient on-state actuation of the valve. A second source of power is provided having a voltage level less than that of the first source of power and of second polarity. A first solid-state switch is actuable between off and on states for impressing the first source of power across the winding and a second solid-state switch is actuable between on and off states for impressing the second source of power across the winding in potential enhancing complement with the first source of power. A control responds to the actuation output for simultaneously actuating the first and second solid-state switches to the on state and for subsequently actuating the first solid-state switch to the off state following an interval selected for enhancing the rate of current build-up within the excitation winding.

Other objects of the invention will, in part, be obvious and will, in part, appear hereinafter.

The invention, accordingly, comprises the system, apparatus and method possessing the construction, combination of elements, and arrangement of parts which are exemplified in the following detailed disclosure.

For a fuller understanding of the nature and objects of the invention, reference should be had to the following detailed description taken in connection with the accompanying drawings.

DETAILED DESCRIPTION OF THE INVENTION

Figure 1:
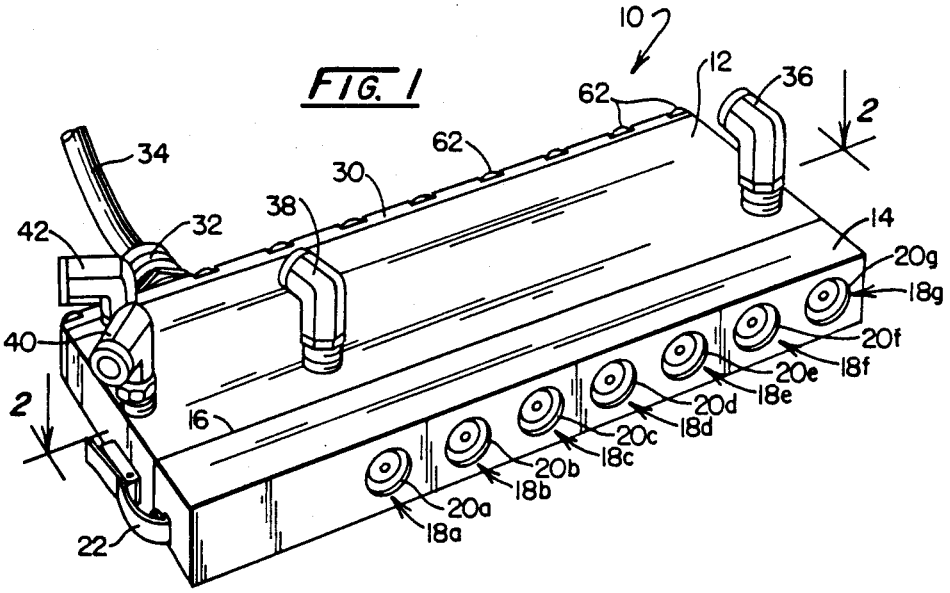
FIG. 1 is a perspective view of a marker assembly according to the invention.

Referring to FIG. 1, a manifold mounted array of marker assemblies formed according to the invention is revealed generally at 10. The body portion or housing for the array 10 serving the manifold function is shown at 12 having a generally rectangular and comparatively compact configuration. A nozzle guard 14 is removably positioned over the front surface 16 of housing 12 and serves to protect the nozzles of an array of seven marker assemblies represented generally at **18*a*–18*g*. Circular openings 20*a*–20*g* are formed in the forwardly-disposed surface of the guard 14 to expose the respective nozzle openings of the noted assemblies 18*a*–18*g*. Guard 14 is retained in position by draw latches 22 and 24 which are associated with respective outwardly protruding keepers 26 and 28 (see FIG. 2). The opposite side of body portion 12 is covered by a valve cover 30 from which extends an electrical connector 32 and multi-lead cable 34**.

The manifold function of the body portion or housing 12 is in evidence in view of the paired elbow fluid couplings 36 and 38 which are coupled to corresponding ports within body 12 extending, in turn, to passages for carrying out the circulating supply of marker fluid or ink. Similarly, an air input to the manifold system is provided by elbow coupling 40 and valve cleaning solvent is introduced into the assembly through elbow coupling 42. In the latter regard, solvent is introduced into the air passage labyrinth of the assemblage for purpose of cleansing them from contaminating marker fluid and the like which may have ingressed thereinto.

Figure 2:
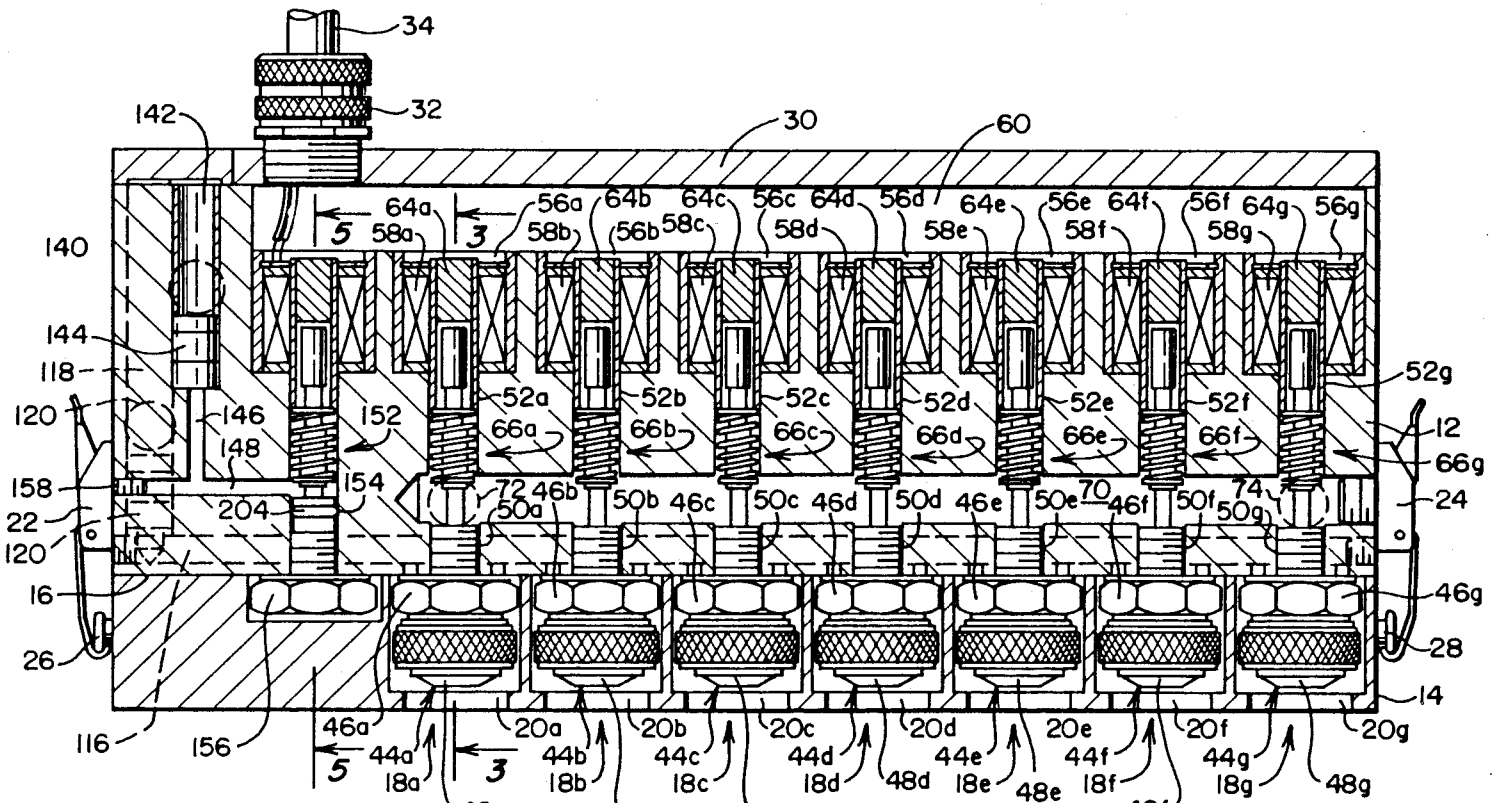
FIG. 2 is a sectional view of the marker assembly of FIG. 1 taken through the plane 2—2 represented therein.

Looking to FIG. 2, it may be observed that each marker assembly of the array **18*a*–18*g* thereof is structured identically, thus alpha-numeric designation of components is employed with the instant description. Each assembly 18*a*–18*g* includes a two-component nozzle 44*a*–44*g* which is formed having a rearwardly disposed fluid cap as at 46*a*–46*g* over which is threadably attached an air cap as at 48*a*–48*g*. Looking additionally to FIG. 3, it may be observed that the fluid cap components 46*a*–46*g* of the nozzle assemblies 44*a*–44*g* are threadably engaged within the forward portions of respective channels or bores 50*a*–50*g* formed within housing 12. The axis of each of these channels 50*a*–50*g* are formed normally or perpendicularly to the flat front surface 16 of housing 12 and extend in somewhat elongate fashion to a rearward portion thereof wherein each supports a respective cylindrical sleeve 52*a*–52*g*. Sleeves 52*a*–52*g* are positioned coaxially within an associated channel 50*a*–50*g* and are formed having an external diameter slightly less than the diameter of the forward portions of channels 50*a*–50*g*. Thus, respective counterbores 54*a*–54*g* are provided at the rearward portion of each channel having a diameter corresponding with the outer diameter of the sleeves. These sleeves are formed of a non-magetic stainless steel, for example a 300 series stainless steel. Connection of the sleeves 52a–52g within respective counterbores 54a–54g of channels 50a–50g is preferably provided by an adhesive, for example an anaerobic adhesive as manufactured by Loc-Tite Corporation of Cleveland Ohio. It may be observed that the sleeves depend rearwardly into larger counterbores as at 56a–56g which serve as cavities for retaining the coils or windings 58a–58g** of solenoid assemblies employed to actuate each marker assembly.

Rearwardly of the solenoid winding cavity bores 56a–56g there is formed within housing 12 a trough 60 of generally rectangular configuration which is utilized to carry the electrical leads extending from cable 34 to windings 58a–58g and other necessary electrical inputs. These windings are essentially sealed within the trough 60 by bolted coupling of the rearwardly disposed valve cover 30 to the body portion 12, employing additionally a liquid gasket to assure the environmentally immune integrity of trough 60. Coupling, preferably, is carried out utilizing machine screws, certain of which are seen in FIG. 1 at 62.

Windings 58a–58g are seen to extend over that portion of each sleeve 52a–52g extending into the solenoid winding cavities 56a–56g. The rearward portion of the sleeves 52a–52g are seen to support respective pole pieces 64a–64g of the solenoid assemblies. These pole pieces 64a–64g perform in conjunction with their corresponding windings 58a–58g and with the armatures of valve stem-armature assemblies represented generally at 66a–66g. Assemblies 66a–66g are seen to extend coaxially within each of the respective channels 50a–50g to provide a valving function for each respective nozzle 44a–44g.

Marker ink or fluid is supplied to channels 50a–50g and their associated valve components from a manifold duct 70 formed as a transversely oriented bore within housing 12. Perpendicularly disposed access bores or openings as at 72 and 74 extend, in turn, from duct 70 to a port or threaded connection with respective elbow couplings 36 and 38 (FIG. 1).

Figure 3:
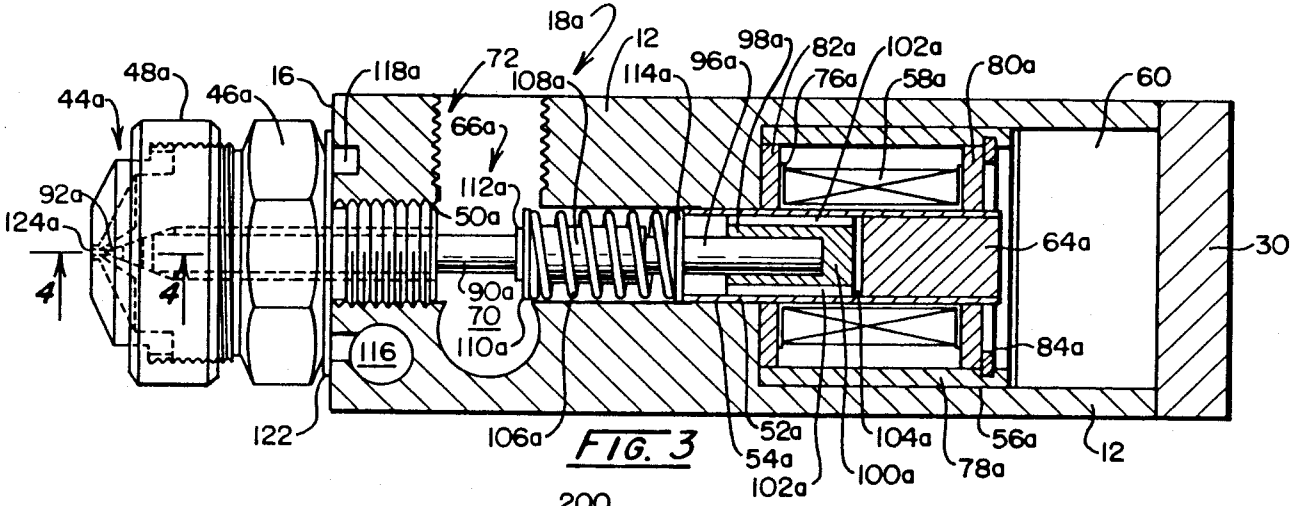
FIG. 3 is a partial sectional view of a solenoid actuated valve component of the assembly of FIG. 2 taken through the plane 3—3 shown therein.

Turning to FIG. 3, a sectional view of marker assembly 18a, being representative of all marker assemblies 18a–18g is revealed at an enhanced level of detail. The figure reveals that the winding 58a is wound upon a thin bobbin 76a formed, for example, of Mylar (polyethylene terephthalate). This bobbin 76a is seen positioned over the sleeve 52a. Additionally, the bobbin is surrounded by magnetic material to assure a flux path for the magnetic circuit of the solenoid. In this regard, a cylindrical frame piece 78a is adhesively secured within the counterbore 56a in a fashion surrounding the winding 58a and, additionally, two washer-shaped disks or end plates 80a and 82a are positioned to nest against the winding 58a and bobbin 76a within the cavity 56a. The assemblage of winding 58a, bobbin 76a, and end plates 80a and 82a are retained in place within the frame 78a by a C-ring 84a. Preferably the end plates 80a and 82a as well as the frame piece 78a are formed of a magnetic stainless steel.

Figure 4:
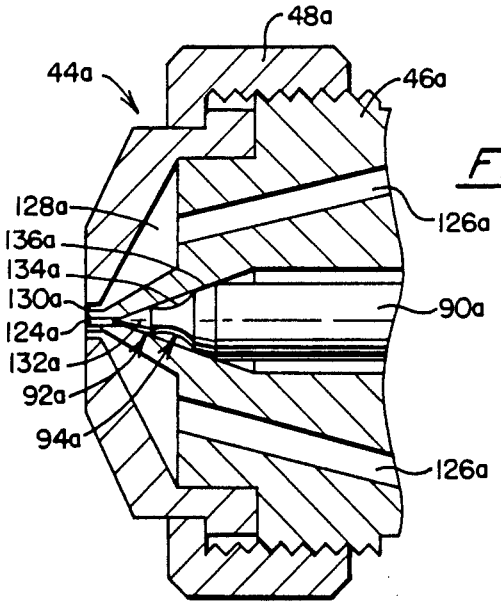
FIG. 4 is a partial sectional view of a nozzle employed with the valve described in FIG. 3 taken through the plane 4—4 therein.

Looking additionally to FIG. 4, the valve stem-armature assembly 66a is seen to be formed of a valve stem 90a having a tip represented generally at 92a which is seatable in closing relationship against a valve seat 94a. From this seated orientation, the valve stem 90a extends rearwardly and coaxially within the channel 50a to an armature retaining portion 96a is slideable into and retained within cylindrical cavity receiving portion 98a of a cylindrical armature 100a formed of a magnetic material such as magnetic stainless steel. Slots as at 102a are formed in the armature 100a to permit movement of marking fluid therealong. Armature 100a is so positioned within the channel 50a that when the tip 92a is nesting in closed relationship against the valve seat 94a, a predetermined gap 104a is defined between the rearwardly disposed surface of armature 100a and the facing forward surface of pole piece 64a. Under the technique of construction of the instant invention, this gap 104a is of identical dimension for each of the armature assemblies 18a–18g and represents the traveling distance for opening of the valve stem-armature assembly 66a–66g. Because of the uniformity of the size or distance defined by the gaps 104a–104g (only gap 104a being identified) and because of the efficiency of opening developed by the solenoid drive approach of the invention, the length of the gaps 104a–104g may be diminished. In the latter regard, the valves typically function in conjunction with gap sizes of 0.020 to about 0.045 inch. To achieve smaller character forming dot or pixel sizes with the instant invention, the gap sizes are within a range of about 0.024 to 0.028 inch. This sizing permits the adjustment of resultant pixel or ink formed dot size to smaller diameters and the uniformity of gap size permits an electrical form of valve adjustment, as opposed to the cumbersome hand adjustments to valve travel heretofore employed in industry.

Valve stem 98 is seen retained in a biased, closed or seated orientation by a helical spring 106a which is positioned over a cylindrical spring mount 108a which, in turn, includes an integrally formed annular flange portion 110a. The mount 108a is retained upon the shaft of valve stem 98 by an adhesive such as that identified above and is positioned thereon during its attachment by a clip 112a which is resiliently positioned on the shaft of stem 90a at a groove (not shown) formed therein. The opposite end of spring 106a is compressively retained against a washer 114a which, in turn, nests against the forwardly protruding cylindrical edges of sleeve 52a extending from channel counterbore 54a.

While marker fluid is supplied to the channel 50a via manifold 70, air under pressure supplied to the nozzle 44a via an elongate duct 116 which communicates with annular troughs as at 118a formed within the surface 16 for each assembly 44a.

Looking to FIG. 2, the duct 116 is seen extending along the lengthwise extent of the housing 12 and is fed by a perpendicularly oriented duct 118 which communicates with the upper surface of housing 12 at an opening 120 to which the elbow coupling 40 (FIG. 1) is connected. A check valve and a filter as represented at 120 additionally are inserted within the duct 118.

Returning to FIG. 3, the nozzle 44a is seen to be threadably coupled to the housing 12, a gasket 122 being provided intermediate those two components. The tip represented generally at 92a of valve stem 90a functions to close off a small orifice 124a formed within the fluid cap 46a. This oriface may, for example, have a diameter of 0.016 inch and it is desirable that the tip 92a form a seat or closure very close to oriface 124a to avoid a phenomenon wherein marker fluid existing forwardly of the valve seat of a closed valve will be drawn out by the continuing air egress from the air cap 48a.

Looking additionally to FIG. 4, air conveying channels 126a are seen communicating from air duct 118a to a chamber 128a formed between air cap 48a and fluid cap 46a. Thus, air passes through an opening 130a in cap 48a to draw fluid outwardly and effect the nebulization thereof to ultimately form a dot or pixel of a dot matrix character upon an adjacent surface to be marked. Valve seat 94a is seen to be formed in conical fashion extending to the opening 124a. This machined cone shape, for example, may have an apex angle of 40°. In accordance with the invention, to avoid valve sticking, for example during utilization of high temperature marker fluids containing ceramic particles and the like, the corresponding structure of the tip 92a of valve stem 90a is arranged to have two seating surfaces of complementary 40° apex angle conical configuration or angle of inclination. The forwardmost of these seating surfaces is shown at 132a, whereupon, tip 92a is configured in atactile or non-contacting relationship with respect to the seat 94a as at region 134a. Region 134a terminates in another seating surface 136a having the earlier-described 40° complementary apex angle. With the arrangement shown, a forward seating area 132a permits seating of the tip 92a in close adjacency with the opening 124a. However, this seating arrangement is butressed by the second or rearwardly disposed seating region 136a such that, as the tip 92a is urged forwardly by spring 106a, two simultaneous seating conditions are established. The arrangement provides for successful seating without the formation of tails or the like in the created dot image while avoiding a sticktion or the sticking effect otherwise observed in conjunction with use of the noted form of marking fluids intended for use in marking surfaces of high temperature.

Figure 5:
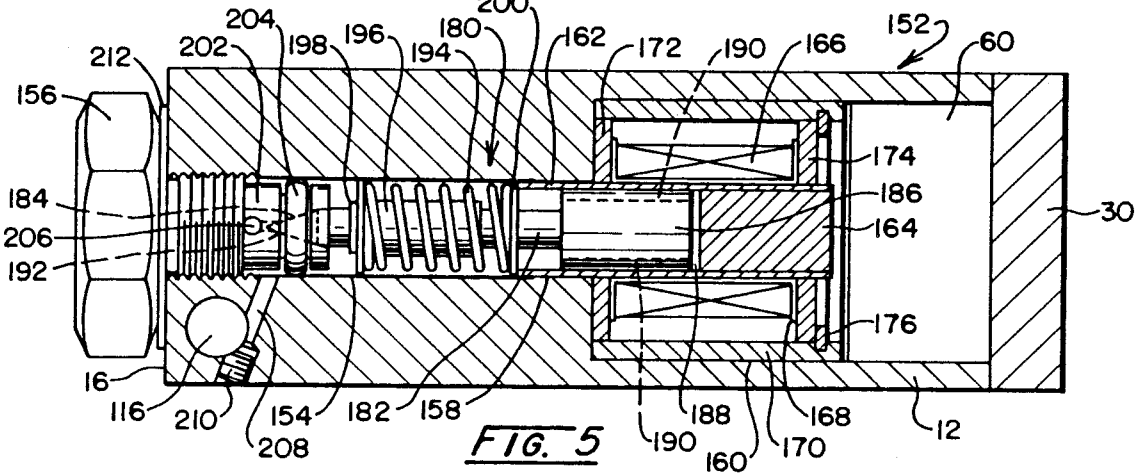
FIG. 5 is a partial sectional view of the apparatus of the invention taken through the plane 5—5 shown in FIG. 2.

Another advantageous aspect of the marker assembly of the invention resides in a feature wherein cleansing solvent may be admitted to the air passages of the array of marker assemblies 18a–18g by valving action located at the housing-manifold 12. Looking to FIGS. 1 and 2, solvent is seen admitted to the housing 12 at elbow coupling 42. As represented in FIG. 2, coupling 42 is, in turn, threadably connected to a port or bore 140 extending to a solvent duct 142. Positioned upstream of the bore 140 within duct 142 is a check valve and filter 144 which leads, in turn, through bore or ducts 146 and 148. The latter duct or bore 148 is seen closed by threaded plug 150. Duct 148, in turn, is seen extending to a solenoid or electromagnetically actuated solvent valve assembly represented generally at 152. Structured in similar fashion as valve assemblies 18a–18g, the assembly 152 is seen to be located within a duct or channel 154 formed normally or perpendicularly to the front surface 16 of housing 12 in the manner of the assemblies 18a–18g. This channel 154 is threadably closed by a valve seat 156. With the exception of this valve seat structure, the solvent valve assembly 152 is advantageously structured in identical fashion with respect to its solenoid drive as are valve stem assemblies 18a–18g. Turning to FIG. 5, the valve seat structure 152 is revealed at an enhanced level of detail. The figure reveals that the rearward portion of channel 154 is counterbored at its rearward portion 158, whereupon it extends to a counterbore form of coil retaining cavity 160 which opens for access into the trough 60. Within the counterbore rearward portion of duct 154 there is adhesively fixed a cylindrical sleeve 162 which, as before, may be formed of a non-magentic stainless steel. Sleeve 162, in turn, retains a pole piece 164 formed of magnetic material. Pole piece 164, as before, is retained within sleeve 162 by an anaerobic adhesive. About the rearwardly extending outer surface of sleeve 162 and within the cavity 160 there is positioned a solenoid winding 166 which is wound upon a thin polymeric bobbin 168 which may be formed, as before, of Mylar (polyethylene terephthalate). The magnetic material structure about winding 166 also is identical to that associated with assemblies 18a–18g. In this regard, a cylindrical frame 170 is inserted within cavity 160 which is formed of a magnetic stainless steel. Frame 170 is adhesively retained in place by the noted anaerobic adhesive. Within frame 170 there are positioned two washer-shaped disks 172 and 174 to complete a requisite magnetic path assemblage. The combination of disks 172 and 174 along with winding 166 at bobbin 168 are retained in position by a C-ring 176.

The valve stem-armature assembly 180 of the valve assembly 152 includes a valve stem 182 mounted essentially coaxially with the axis of channel 154 which extends from a conical tip 184 to a rearward portion slideably insertable within a corresponding cylindrical receiving portion of magnetic armature 186. This connection of armature 186 with stem 182 is by the noted anaerobic adhesive and is arranged so as to define a gap 188 between the rearward face of armature 186 and the forwardly disposed face of pole piece 164. Preferably, this gap is established of identical extent with gaps 104a–104g of the marker valve assemblies 18a–18g. Slots as at 190 are formed within the aperture 186 to enhance its maneuverability. As before, the gap 188 determines the extent of opening for the valve stem tip 184. Tip 184 is retained in a closed orientation within a conically shaped receptor or seat 192 of valve seat 156 by a helical spring 194. As before, one end of spring 194 is biased against the outwardly extending flange of a spring retainer 196 which is fixed to the stem 182 by an anaerobic adhesive. The location of the retainer 196 is established during its fabrication by a small clip 198. The opposite side of spring 194 is seen to abut against a washer 200 which rests, in turn, against the forwardly disposed edge of sleeve 162. Seat or receptor 192 of the valve seat 156 is formed within a cylindrical extension 202 of the seat which, in turn, carries a groove within which is positioned a sealing O-ring 204. Thus, solvent introduced rearwardly of O-ring 204 from bore 148 (FIG. 2) is restricted from entering the channel 154 on the forward side of O-ring 204. Upon the energization of winding 166, the armature 186 is retracted into contact with the forward face of pole piece 164 and fluid is permitted to flow through the opening within the valve seat or receptor 192, whereupon it exists from cross ports as at 206 and then is directed via angular bore 208 into the air duct or passage 116. Bore 208 is seen plugged at the housing 12 surface by threaded plug 210. A gasket 212 is seen positioned intermediate the face 16 and seat 156.

The method for forming the marker assemblies, as well as the solvent valve assembly so as to achieve a uniform size for gaps 104a–104g and 188 is accomplished by establishing certain datum planes and carrying out assembly in accordance therewith utilizing relatively simple assembly jigs. The first of such datum planes is represented by the forward surface 16 of housing 12 and the second is the represented by forward surface of the pole pieces 64a–64g, as well as the forward surface of pole piece 164. In the discourse to follow, the assembly is described in conjunction with the components of the marker valve assemblies 18a–18g and, in the interest of clarity, the alphabetical suffixes for the components of the assemblies are not identified.

Figure 6:
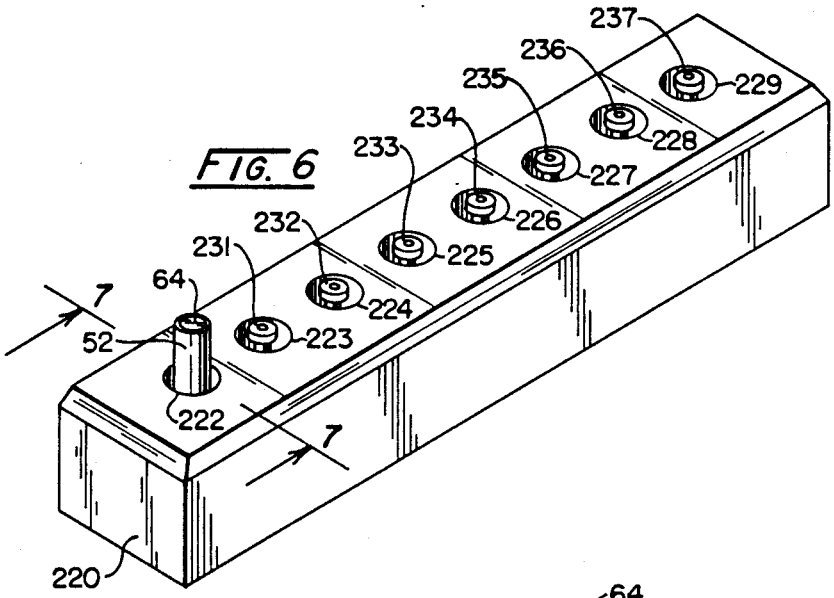
FIG. 6 is a perspective view of an assembly jig employed with the method of the invention.
Figure 7:
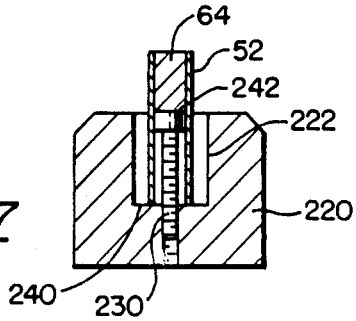
FIG. 7 is a sectional view taken through the plane 7—7 in FIG. 6.

As an initial procedure in this assembly technique, an assembly jig for carrying out the assembly of each pole piece 64 with sleeve 52 is provided. Looking to FIGS. 6 and 7, this assembly jig is represented at 220. Jig 220 is formed as an elongate metal block having eight cylindrical bores 222–229 formed therein. Within each bore 222–229 there is centrally threadably attached a locator component which may be provided as adjustable machine screws represented, respectively, at 230–237. The upwardly disposed faces of screws 230–237 serve as reference surfaces and are adjusted with accuracy to be a predetermined distance above the bottom seating surfaces of respective bores 222–229, the bottom seating surface, for example of bore 222 being seen in FIG. 7 at 240. With this arrangement, a sub-assembly of pole piece 64 and sleeve 52 is formed by inserting the pole piece 64 within sleeve 52 in conjunction with an anaerobic adhesive as above described and positioning the forwardly disposed edge of sleeve 52 against the surface of the bores 222–229 as shown at 240. The adhesive is permitted to cure and, thus, an accurate positioning of the forwardly disposed face of plug 64 is provided with respect to the forwardly disposed edge of sleeve 52.

The pole piece-sleeve assembly of sleeve 52 and pole piece 64 is inserted and fixed within the housing 12 utilizing the above-noted anaerobic adhesive. However, this step is carried out so as to accurately establish the distance between the forward face of pole piece 64, for example as represented at 242 with respect to the forward face 16 of housing 12. In effect, a first datum is established by the face 16 and a second datum is established by the forward face 242 of each pole piece 64.

Figure 8:
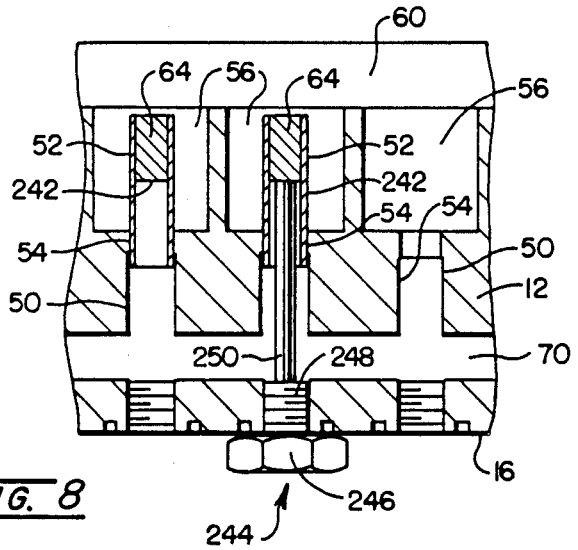
FIG. 8 is a partial sectional schematic view of the apparatus of FIG. 1 showing a step in the assembly method of the invention.

Looking to FIG. 8, a technique by which the distance between these two datum planes may be established is represented. In this regard, a gauge or caliper type tool 244 is utilized which has a head portion 246 coupled with a threaded portion 248 and a shank 250. Tool 244 is screwed into the threaded components of each channel 50 and its outward tip is engaged with forward surface 242 of the pole pieces 64. Sleeve 52 then is attached to counterbore 54 by the noted anaerobic adhesive and permitted to cure. Following this procedure, there then is established an accurate and consistent fixed distance between the datum plane represented by surface 16 and the datum plane represented by surface 242. Following curing of the adhesive, the tool 244 is removed. The assembly of frame 78, frames 80 and 82, along with a preassembled bobbin 76 and winding 58 may then be positioned within the cavities 56, the frame 78 being mounted therein with the noted anaerobic adhesive and the remaining components being retained by C-rings as at 84 (see FIG. 3).

Figure 9:
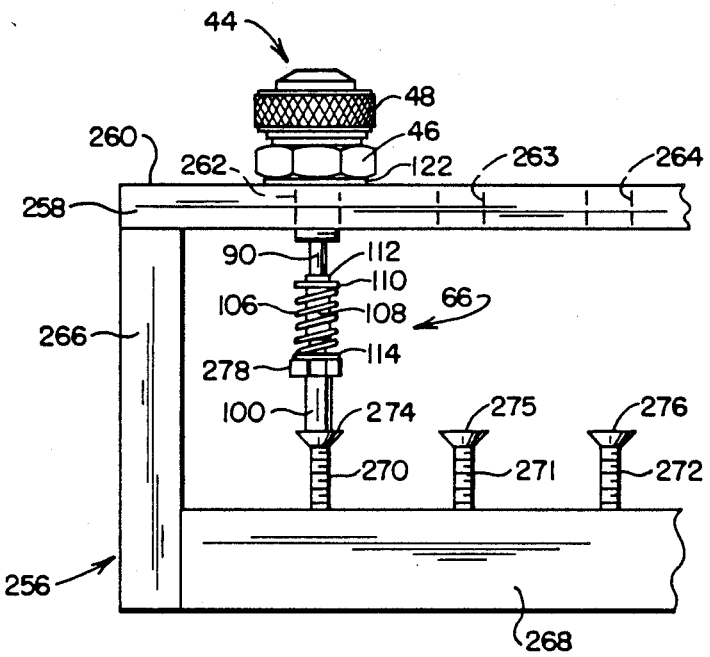
FIG. 9 is a partial elevational view of a stem assembly jig utilized with the method of the invention.

Upon the completion of the assembly technique to this stage, the procedure then turns to the formation of the valve stem-armature assemblies 66. Referring to FIG. 9, a stem assembly jig for carrying out fabrication of the assembly 66 is represented generally at 256. Jig 256 includes an upper support 258, the upwardly-disposed surface of which at 260 represents a third datum plane corresponding with the first datum plane represented by forward face 16 of housing 12. Through this upper support 258 there are formed a series of eight threaded bores or openings, three of which are revealed at 262–264. These openings 262–264 correspond with and are dimensioned identically with the openings formed through forward face 16 for threadably receiving nozzle assemblies 44a–44g. Upper support 258 is supported from two side supports, one of which is revealed at 266, the latter, in turn, being fixed to bottom support 268. Positioned coaxially with the openings 262–264 and the remaining such openings are a corresponding sequence of upstanding locator components, three of which are revealed at 270–272. These components 270–272 and the remaining such components are provided, for example, as flat headed machine screws, each threaded within lower support 268 and extending upwardly such that their upper surfaces, three of which are revealed respectively at 274–276 may be employed as a fourth datum plane.

A preliminary sub-assembly is prepared for utilization with the stem assembly jig 256. In this regard, a spring mount 108 is adhesively attached to a valve stem 90, the appropriate location of the mount 108 being derived through the use of the small spring clip 112 which snaps into a corresponding groove (not shown) on each stem 90. Anaerobic adhesive is employed for this mounting and following the curing of the adhesive, helical spring 106 is positioned over the spring mount 108 and against the outwardly extending flange 110 thereof. A washer 114 then is positioned over the opposite end of spring 106. The nozzle to be used at a given location within housing 12 (nozzle 44), or at least the fluid cap 46 thereof then is attached with gasket 122 to one of the aforesaid openings, for example, as shown in FIG. 9 at opening 262. The fluid cap 46 or nozzle 44 then is threadably mounted in place using the same procedures as for its final mounting, i.e. using gasket 122 or accommodating for it. Thus, the third datum plane associated with surface 260 is employed in conjunction with the actual nozzle 44 to be used in the finally assembled product, the seat 94 of the nozzle 44 thus being positioned with respect to a known datum plane. The preliminary assemblage of stem 90, spring 106, spring retainer 108, and washer 114 is now inserted such that the tip 92 of the stem 90 is positioned in seated relationship with the seating surface 94 of the nozzle being assembled. The opposite end of stem 90 is inserted within the cylindrical receiving cavity or portion of an armature 100, the rearwardly disposed surface thereof being positioned in abutting contact with a reference surface such as that at 274 as revealed in FIG. 9. Anaerobic adhesive also is applied to the back end of stem 90 and receiving portion of armature 100 to effect their connection. Preferably, a small U-shaped spring clip 278 then is inserted between the washer 114 and the forward surface of armature 100 to bias the stem 90 upwardly and the armature 100 downwardly against reference surface 274. The distance between reference surface 274 and surface 260 is adjusted to represent the distance between the noted first datum plane at forward surface 16 of housing 12 and the second datum plane representing the forwardly facing surface of pole piece 52 (FIG. 8) less a distance representing the predetermined extent of gap 104. Following the curing of the adhesive providing the connection between stem 90 and armature 100, the subassembly 66 is removed from jig 256 and assembled with nozzle 44 in an appropriate channel or bore 50 of housing 12. This procedure is reiterated with respect to each of the corresponding openings within upper supports 258 and the locator components extending from lower support 268. Preferably, eight such stations for the stem assembly jig 256 are provided. Because of the accuracy of this assembly technique, all valve opening distances are equal and an electronic control becomes available for the adjustment of resultant dot size based upon the interval of opening and closing. Manual adjustments in the field are not required and are not provided for with the assembly of the invention. Of course, should a failure result in connection with a winding as at 58, field replacement is readily carried out by removing the C-rings 84 at the rear of the housing 12. Another advantage accruing with the disclosed assembly provides for accessing the moving parts thereof from front surface 16 to carry out periodic preventive maintenance procedures such as cleaning and the like. As noted above, the assembly of solvent valve assembly 152 is carried out in the same manner as described in conjunction with FIGS. 6–9.

As discussed earlier herein, an advantageous feature of the valve assemblies of the instant invention resides in a capability for adjusting resultant formed pixel or dot size by adjusting the interval of opening and closing. Because such an adjustment can be carried out utilizing electronic devices, a considerable convenience is developed for the operator. One aspect of achieving this form of size control is developed through the structural aspect of closely controlling the extent of travel of valve stems as at **90*a*–90*g* or, stated otherwise, controlling the extent of gaps 104*a*–104*g* with close tolerances. Dot size control is further enhanced by achieving an efficiency of the dynamics of such opening and closing. In this regard, it is important that the windings as at 58*a*–58*g*** reach saturation as quickly as possible and, conversely, that they be turned off rapidly while still controlling the necessarily encountered inductive spikes for such action. The control system of the instant invention achieves these desired dynamic efficiencies, which, as noted above, achieve the advantageous result of permitting dot matrix character formation at substantially improved line speeds.

Figure 10A:
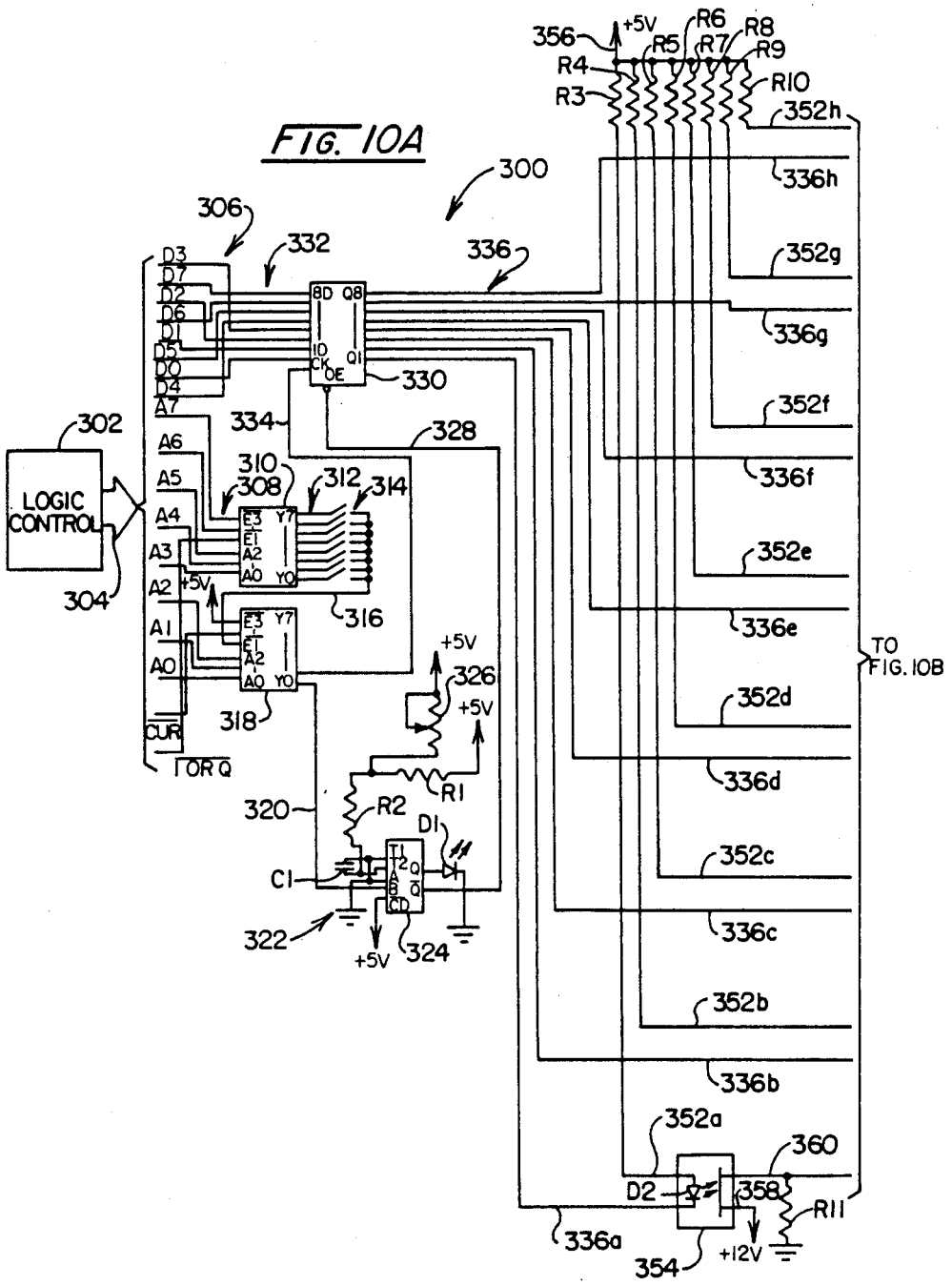
FIGS. 10A and 10B combine in accordance with the labeling thereon to show a schematic electrical diagram of the control system of the invention with repetitive portions therein revealed in block fashion.
Figure 10B:
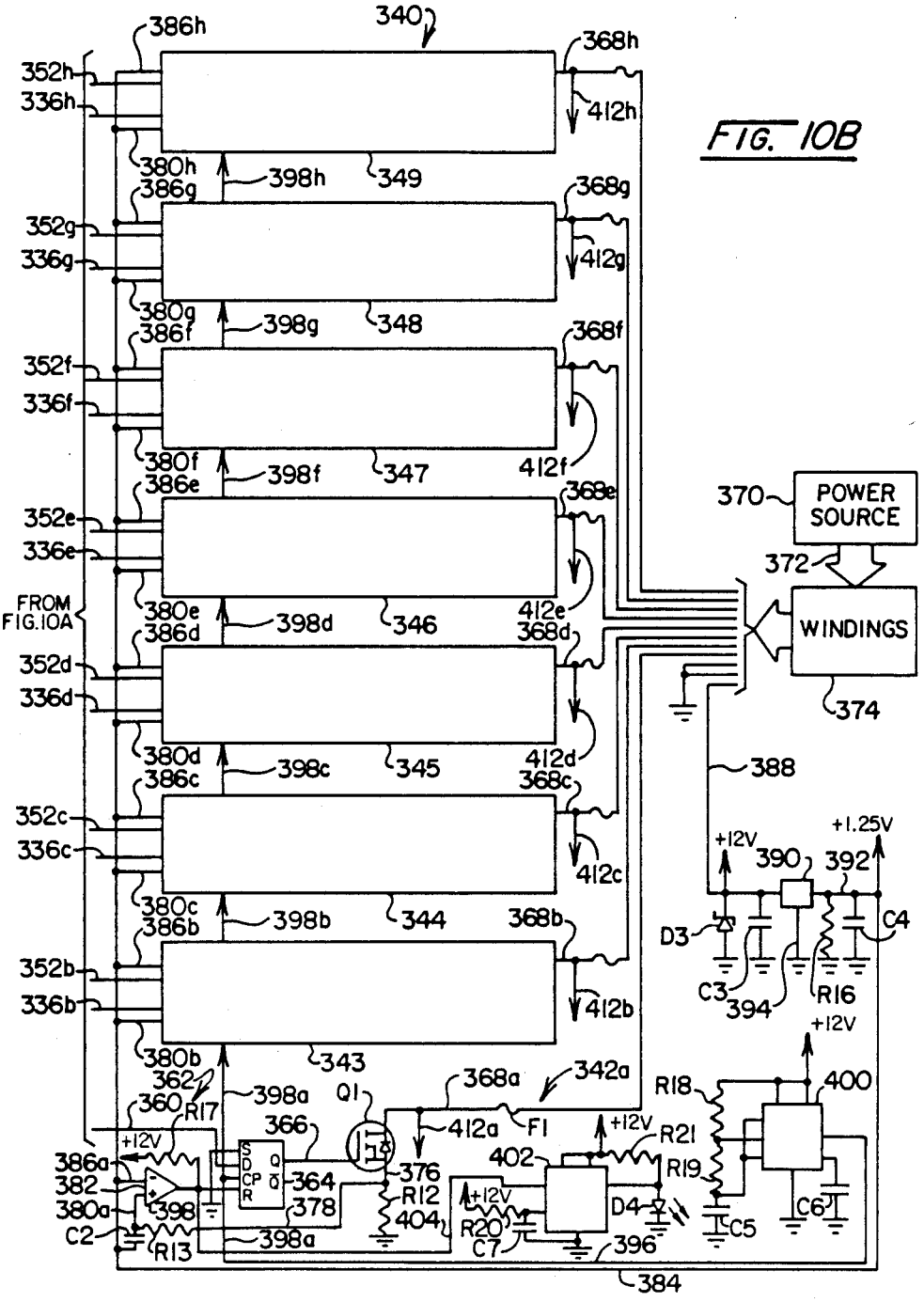

Looking to FIGS. 10A and 10B, the control system of the invention is represented generally at 300. The control system responds to computer derived inputs which are represented in FIG. 10A as a logic control at block 302. This logic control 302 provides logic inputs to the control system 300 as represented by arrow 304 directed to an array of inputs shown generally at 306 and including data input terminals D0–D7, address inputs A0–A7, as well as a $\overline{WR}$ input and an $\overline{IORQ}$ input (input/output request). Address inputs A3 through A7 as well as the $\overline{IORQ}$ input are directed as represented by line array 308 to the E1–E3 and A0–A2 inputs of a three to eight line decoder 310. Device 310 may, for example, be provided as a type 74LS138. The corresponding Y0–Y7 outputs of decoder 310 are directed via line array 312 to the discrete inputs of switch array 314, the outputs of which are coupled in common with line 316. With the arrangement of switch array 314, the address pattern asserted to decoder 310 may be manually designated by arrangement of these switches to a predetermined pattern. The resultant output at line 316 is, in turn, directed to the $\overline{E1}$ terminal of a second three line to eight line decoder 318 which may be identical to that at 310. The A0–A2 input terminals of decoder 318 are coupled to corresponding A0–A2 address inputs from the logic control 302, while the $\overline{E2}$ terminal thereof is coupled with the write terminal of the control input. The Y0 output of the device 318 is connected via line 320 to a timer network represented generally at 322. Network 322 includes a retriggerable/resettable monostable multivibrator 324, the B input to which is coupled to line 320. Device 324 may be provided, for example, as a type 4538 monostable multivibrator marketed by Motorola, Inc. Device 324 may be triggered from either edge of an input pulse, and will produce an accurate output pulse over a range of widths, the duration and accuracy of which are determined by external timing components including a hand adjustable potentiometer 326 operating in conjunction with resistors R1, R2, and capacitor C1 representing an RC timing network coupled with the T1 and T2 input terminals of device 324. The hand adjustment of potentiometer 326 provides for determining the duration of excitation of the solenoid windings of the system. As noted earlier herein, because of the efficiency of actuation and the uniformity of fabricability of the solenoid actuated valves, a remote adjustment for dot image size can be achieved by the relatively simple expedient of manually adjusting potentiometer 326. The pulse width output of device 324 at line 328 may vary, for example, from about 1 millisecond to about 12 milliseconds, an interval of three to four milliseconds being typically utilized in practice. The timing signal at line 328 is directed to the output enabling, OE, terminal of an eight bit latch 330 and functions to enable the Q1–Q8 outputs thereof for the interval derived by network 322. During this same output, a light emitting diode, D1 coupled between the Q terminal of device 324 and ground is illuminated to provide a visual indication that the components receiving logic inputs from logic control 302 are active. Latch 330 may be provided, for example, as a type 74LS374 and the input terminals thereof at 1D–8D are seen coupled to the logic inputs at terminals D0–D7. Solenoid valve selection data as submitted via line array 332 are transferred to the Q outputs of device 330 upon the occurrence of a clock input from line 334 extending from the Y1 terminal of decoder 318. Resulting actuation outputs at select ones of terminals Q1–Q8 of device 330 at line array 336 are submitted as the output of the logic input receiving arrangement to the switching and control components of the control system. The duration of such actuation outputs at array 336 is controlled from line 328 and network 322 by, in turn, controlling the enablement of latch 330 at its output enable (OE) terminal.

The array of actuating output lines 336 extends to an energization control network represented in FIG. 10B at 340 and comprised of eight identically structured solenoid driver networks 342–349. Inasmuch as these networks 342–349 are identical, only that at 342 is illustrated in detail, the remaining networks 343–349 being represented in block schematic form.

Actuation outputs from latch 330 and line array 331 are low true and are seen in FIG. 10A to be directed, as represented by array lines **336*a*–336*g*, to inputs of respective networks 342–349. Looking specifically to network 342, line 336*a* is seen in FIG. 10A to be directed to one input of an opto-isolator 354. Device 354 may be provided as a type H11F2 and, in conventional fashion includes a light emitting diode D2, the cathode of which is coupled to array 336, line 336*a* and the anode of which is coupled to line 352*a* which is seen to extend through pull-up resistor R3 to +5 v at line 356. In similar fashion, lines 336*b*–336*g* extend to corresponding opto-isolators within respective networks 343–349 (FIG. 10B) and corresponding anode coupled lines 352*b*–352*h* extend through respective anode coupled lines 352*b*–352*h* extend through respective pull-up resistors R4–R10 to +5 v at line 356. These opto-isolators as at 354 function to prevent noise and similar aberrations generated at the high voltage function of the circuit from disturbing the relatively low level voltage digital circuitry. Isolator 354 is seen also incorporating a photoresponsive switching element, one side of which is coupled to +12 v via line 358 and the opposite side of which at line 360 is seen coupled to pull-down resistor R11 to ground and to extend (FIG. 10B) to a current control and monitor network represented generally at 362. Line 360, in particular, is seen directed to the D input terminal of a D flip-flop 364. Thus, this D terminal develops an on state for the control network 362 upon receipt of an actuation output from array 336 as applied through line 360. This actuating output is provided then as a positive going signal at the Q terminal of flip-flop 364 which is directed via line 366 to the gate of a solid state switch or power transistor Q1. Transistor Q1 provides a current mode control over solenoid winding energization or excitation and may be provided, for example, as a type IRFD220 power MOSFET transistor. The drain terminal of transistor Q1 is coupled via line 368*a* incorporating fuse F1 to one side of an excitation winding of a solenoid valve, such windings being described heretofore as at 58*a*–58*g*, as well as as at 166 (FIG. 5). Lines corresponding to line 368*a* associated with networks 343–349 are represented respectively at 368*b*–368*h*. In order to achieve the efficiency of operation called for in the solenoid actuation of the valves, it is improtant that the rate of supply of current to these windings be as rapid as possible when an opening form of actuation is involved. Thus, a relatively high voltage power source, for example at the 90 volt level is supplied to the opposite side of the windings. This power source is represented at block 370 being applied as represented by arrow 372 to the above-noted windings now represented at block 374. Accordingly, upon the gating of power transistor Q1, the full 90 volt power source is applied to these windings by the development of a circuit across transistor Q1 through its source terminal and line 376 to ground. Line 376 may be seen to incorporate a source resistor R12. As the current rapidly builds up within the excitation winding of the solenoid at hand, that build-up is monitored by the current monitoring network which senses the corresponding voltage build-up across source resistor R12 at line 378. Line 378, in turn, is directed via line 380*a* to the non-inverting input of an operational amplifier or comparator 382. Device 382 may be provided, for example, as a type MC3302. A noise filter comprised of resistor R1 in line 378 and capacitor C2 in line 380*a* is provided within this monitoring input to device 382. The opposite input to operational amplifier 382 is provided from lines 384 and 386*a*. These lines carry a reference voltage functioning to establish the maximum current levels which are permitted through the excitation windings involved. The reference voltage is derived from +12 v supply at line 388 which is directed, in turn, to an adjustable, three-terminal positive voltage regulator 390, the output of which, in turn, at line 392 is coupled with line 384. Regulator 390 may be provided, for example, as a type LM317L marketed by Motorola, Inc. By-pass capacitors C3 and C4 are seen coupled to ground and with respective lines 388 and 392. To prevent these capacitors from discharging through low current points into the regulator 390, a protection type Zener diode D3 is coupled between line 388 and ground. Finally, regulator 390 is coupled to ground through line 394. The resultant reference voltage, for example at 1.25 v then is asserted via lines 392, 384 and 386*a* to the inverting input of operational amplifier 382. With such a reference, for example, the current within each excitation coil may be limited to about 0.6 amperes, whereupon, the gate input at line 366 is removed to turn off power transistor Q1. This is accomplished by the generation of a logic high value at output line 396 which is directed to the reset (R) terminal of flip-flop 364. Line 396 is seen coupled through pull-up resistor R17 to +12 v supply. The reset status of flip-flop 364 will remain until a clock pulse is received at its CP terminal input. It may be observed that line 384 carrying this reference signal voltage is coupled to solenoid driver networks represented at blocks 343–349 via respective line inputs 380*b*–380*h* and 386*b*–386*h***.

With the removal of a gating input at line 366 to power transistor Q1, the current witnessed by virtue of the voltage level at line 378 will diminish until the output at line 396 of operational amplifier 382 will assume a logic low status. However, the reset condition will remain until the flip-flop 364 is clocked to assert the signal from line 360 and terminal D to its Q output at line 366 and thus, to gate power transistor Q1 into a conducting condition. The noted clock pulses of the current control network are developed from line **398*a* which extends to the output of an oscillator 400. Coupled to +12 v and configured with resistors R18 and R19 as well as capacitors C5 and C6, the oscillator 400 may be provided, for example, as a type LM555 and, for the instant purpose, may provide, for example, a 33 KHz output. Accordingly, upon flip-flop 364 being reset in consequence of the comparison made at operational amplifier 382, a next succeeding clock pulse from line 398*a* will effect the transfer of the enabling signal or on-state signal from the D input thereof to the Q output thereof at line 366 to again gate power transistor Q1 into conduction and the excitation winding at hand is fully excited by the large 90 v power source 370 under conditions of very high current input rate. The current on-switching arrangement described displays very low heat generation and very efficient current switching. The oscillator 400 output is directed in common to all of the solenoid driver networks 342–349. This common assertion of the clock pulse from the network is represented by input lines 398*b*–398*h* for respective circuits 343–349**.

A perceptible output is provided with the control system as a light emitting diode D4. The energization of diode D4 is controlled by a type LM558 trigger circuit 402 conventionally referred to as a pulse "stretcher". The circuit 402 is configured in conjunction with resistors R20, and R21 as well as capacitor C7 to respond with an energization output for diode D4 of length sufficient to remain practically perceptible in conjunction with the sensing via line 404 of the logic high output of operational amplifier at line 396. In the presence of such a logic high level at line 396, the operator may observe by the energization of diode D4 that current indeed was switched into excitation winding controlled by this particular solenoid driver network.

The efficiency of operation of the solenoid actuated valves of the marker assembly of the invention includes not only an efficiency of opening as developed by the current switching network described above, but also in evolving an efficient valve closing performance. To achieve an efficiency in the latter regard, it is necessary to accommodate the necessarily encountered high voltage inductive spike at turn-off of power transistor Q1 by permitting it to be maintained at a high but non-destructive voltage level. To provide for such control, a dynamic clamping network is coupled in common with each of the solenoid driver networks 342–349 by tapping the lines 368*a*–368*h* leading to the individual solenoid excitation windings. This tap is represented for networks 342–349 at respective lines 412*a*–412*h*.

Figure 11:
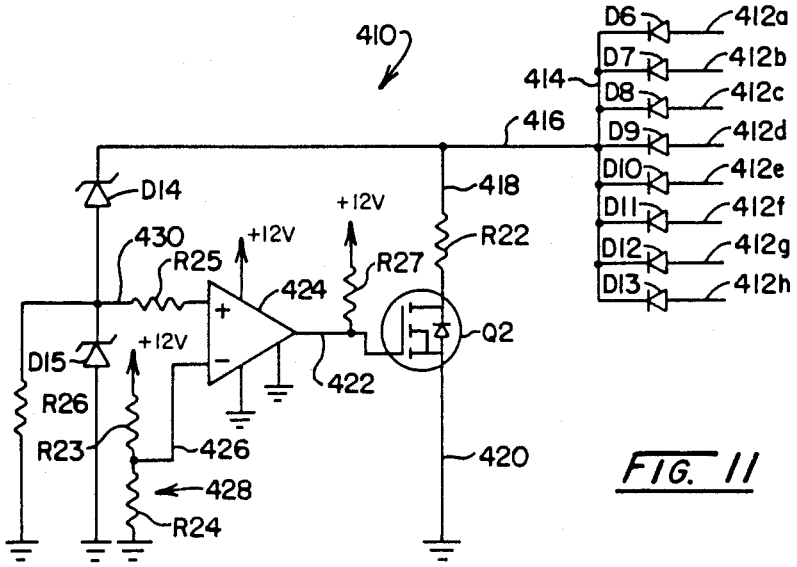
FIG. 11 is an electrical schematic diagram of a dynamic clamping network employed with the control circuit of FIGS. 10A and 10B.

Turning to FIG. 11, the dynamic clamping network is revealed in general at 410. Tap lines 412*a*–412*h* are reproduced in the figure and are seen to extend through respective isolating diodes D6–D13 to lines 414 and 416. Line 416 is seen coupled with line 418 containing current limiting resistor R22 and directed to the drain terminal of power transistor (MOSFET) Q2. Transistor Q2 may be provided as the same type solid-state switching device as provided at transistor Q1 described in FIG. 10B. The source terminal of transistor Q2 is coupled via line 420 to ground. Thus, the transistor Q2 is coupled in switching relationship between the excitation coils and ground from a location intermediate switching component Q1 and the solenoid valve excitation coils. Transistor Q2 is gateable into conduction from line 422 which, in turn, is coupled to the output of an operational amplifier 424, provided, for example, as a type LM311. The inverting input to amplifier 422 is connected by line 426 to a reference voltage network 428 comprised of resistors R23 and R24 which, in turn, are coupled between +12 v supply and ground. Network 428 functions to provide a small reference level, for example, of about 3 volts to elevate the input to the inverting terminal of amplifier 424 to a convenient value above ground.

Line 46 is seen to extend to Zener diodes D14 and D15, the anode of the latter being coupled to ground. A line 430 couples the cathode of diode D14 to the non-inverting input of amplifier 424. With the arrangement shown, a high voltage inductive spike will be limited to a predetermined value (for example 180 v) by diode D14 for assertion at amplifier 424. When the inductively-induced voltage or spike reaches the predetermined reference level of network 428, for example about 3 v, plus the voltage level established by diode D14, i.e. about 183 v, a positive output will be developed at line 422 from amplifier 424 to gate transistor Q2 into conduction and dissipate the voltage spike. Resistors R25 and R26 within line 430 provide a current path for the Zener diode D14 to ground. A pull-up resistor R27 coupled between line 422 and +12 v is provided to enhance the performance of transistor Q2. Amplifier 424 along with network 428 and diode D14 thus function as a voltage monitoring network which responds to the counter EMF generated within the excitation coil of a given solenoid valve. The network 410 permits the counter EMF to reach a significant value, i.e. 183 v permitting the excitation winding of the involved valve to be removed from a saturated state, i.e. to turn off, however, the level permitting this condition is not one otherwise causing damage to the circuit or effecting interference with other channels of the control system.

Figure 13A:
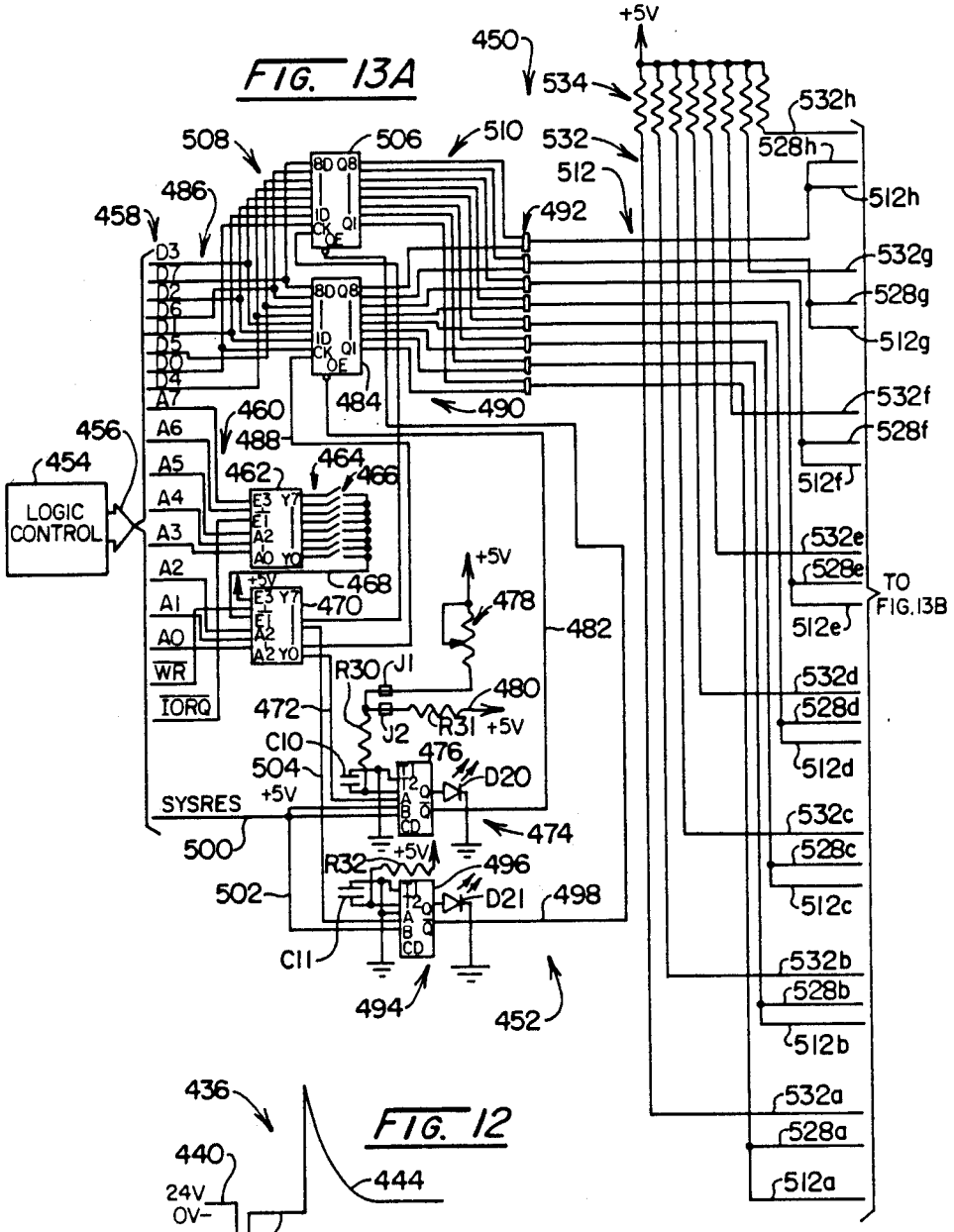
FIGS. 13A and 13B combine in accordance with the labeling thereon to show a schematic electrical diagram of another embodiment of the control system of the invention with repetitive portions therein revealed in block fashion.
Figure 12:
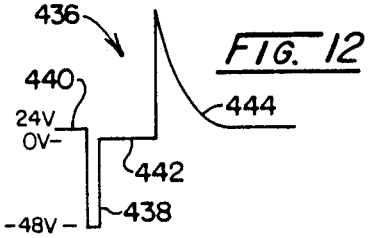
FIG. 12 is a voltage curve at the driven side of an excitation winding employed with the system of the invention.
Figure 13B:
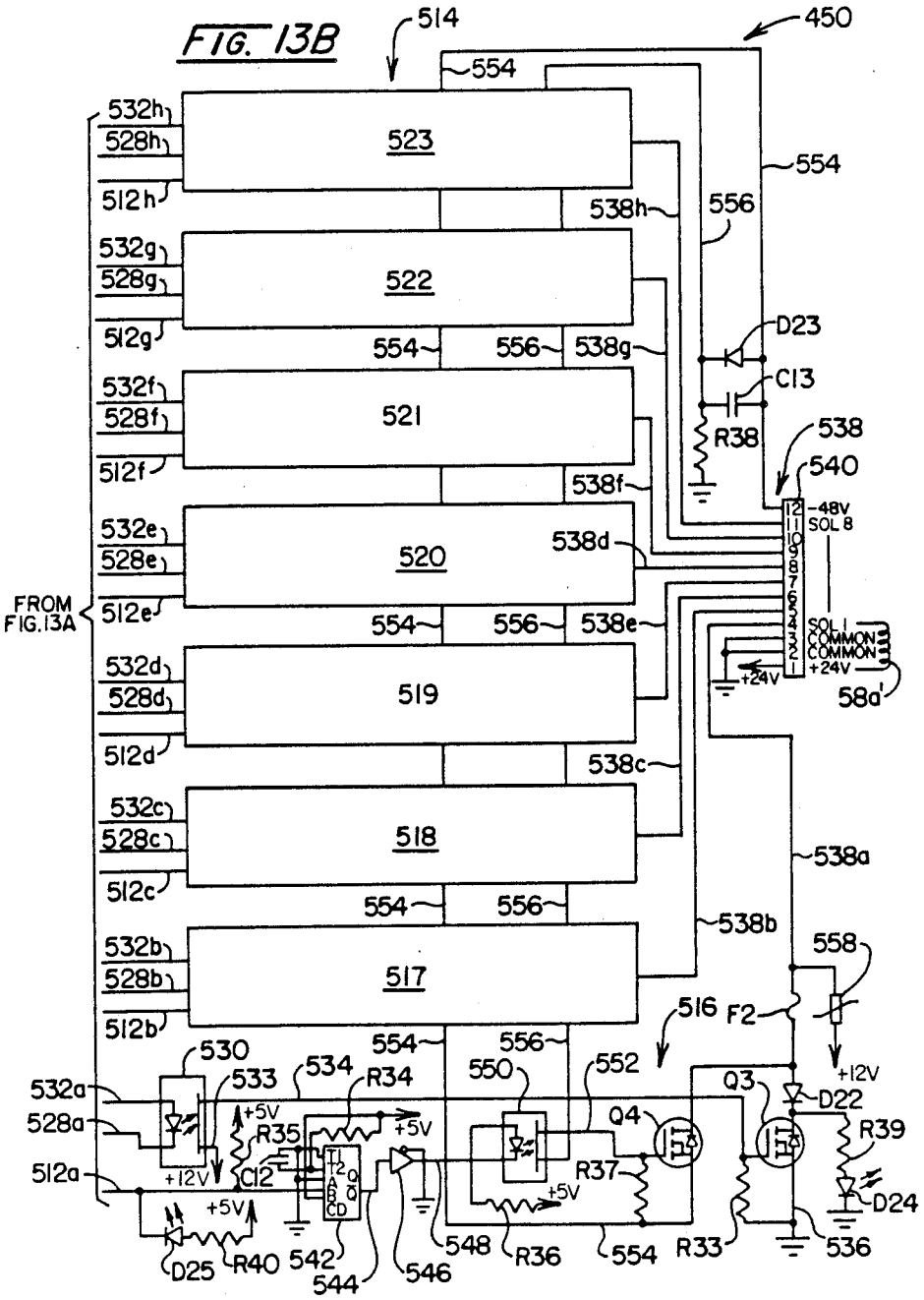

Another, preferred approach to developing saturation within the windings as at 58*a*–58*g* as quickly as possible is revealed in conjunction with FIGS. 12 and 13A–13B. Referring to FIG. 12, the approach taken by this embodiment is represented in terms of an output voltage waveform. With the approach, an initial high potential difference is imposed across the solenoid excitation winding. However, this larger potential difference is achieved by combining inputs from two power sources of differing polarity. In this regard, preferably a +24 v source is imposed across the winding simultaneously with the imposition of a −48 v source. The latter source is imposed in potential enhancing complement such that the potential difference exceeds 90 v and a very rapid excitation of the winding occurs to permit efficient valve opening. Such a waveform is represented, in general, at 436. Curve 436 is representative of the driven or signal side of the excitation network wherein the +24 v source is continuously applied. Curve 436 shows the initially imposed +24 v level at 440 and −48 v level at 438. The −48 v level, however, is imposed for only a short interval selected as adequate to achieve full opening of the valve. In general, this interval will be about 60 milliseconds. Upon the termination of this initial short interval of total valve actuation, the −48 v source is removed and, in view of the continued imposition of the +24 v source, the valve remains held open and the otherwise incurred very large inductive spike is avoided. At the end of the total interval of holding the valve open as represented by curve portion 442, the +24 v source is removed and the valve closes. The system then must accommodate an inductive spike as represented at curve portion 444 which is of substantially lesser magnitude than would be encountered with the larger initially imposed potential difference.

Looking to FIGS. 13A and 13B, this preferred approach to the control system of the invention is represented generally at 450. The input 452 to the control system 450 responds, as before, to computer derived inputs which are represented in FIG. 13A as a logic control at block 454. This logic control 454 provides logic inputs to the circuit input 452 as represented by arrow 456 which, in turn, is directed to an array of labeled inputs shown generally at 458 and including data input terminals D0–D7, address inputs A0–A7, a write input, $\overline{WR}$, input/output request terminal, $\overline{IORQ}$, and a system reset, SYSRES. Address inputs A3 through A7 as well as the $\overline{IORQ}$ input are directed, as represented by line array 460 to the E1–E3 and A0–A2 inputs of a 3 to 8 line decoder 462. Device 462 may, for example, be provides as type 74LS138. The corresponding Y0–Y7 outputs of decoder 462 are directed via line array 464 to the inputs of a switch array 466, the outputs of which are coupled in common with line 468. As before, the address pattern asserted to decoder 462 may be manually designated by appropriate arrangement of the orientations of the switches 466. The resultant output at line 468, in turn, is directed to the $\overline{E1}$ terminal of a second, 3 line to 8 line decoder 470 which may be identical to that at 462. The A0–A2 input terminals of decoder 470 are coupled to corresponding A0–A2 address inputs from the logic control 454, while the $\overline{E2}$ terminal thereof is coupled with the write terminal of the control input. The Y0 output of device 470 is connected via line 472 to a timer network represented in general at 474. Network 474 includes a retriggerable/resettable monostable multivibrator 476, the A input to which is coupled to line 472. Device 476 may be provided, for example, as a type 4538 monostable multivibrator marketed by Motorola, Inc. The device may be triggered from either edge of an input pulse, and will produce an accurate output pulse over a range of widths, the duration and accuracy of which are determined by external timing components which, inter alia, include a hand adjustable potentiometer 478 operating in conjunction with resistor R30 and capacitor C10 representing an RC timing network coupled with the T1 and T2 input terminals of device 476. Note that potentiometer 478 is coupled to resistor R30 and device 476 through a jumper J1. Alternately, the device 476 may be configured to react to the +5v input at line 480 containing a resistor R31 and jumper J2. Where this line 480 is activated by closing jumper J2 and opening jumper J1, the timing output of device 476 is established at a maximum value which may be selectively interrupted for shorter durations by software commands from line 472.

The hand adjustment of potentiometer 478 and similarly potentiometer 326 as shown in FIG. 10A provides for determining the duration of excitation of the solenoid windings of the system. This form of adjustment is quite advantageous inasmuch as the operator may observe performance of the system while hand adjusting or fine tuning it to optimum operation. This follows, inasmuch as the potentiometer devices may be located at a position permitting such real time observation. The pulse width output of device 476, as before, may vary, for example from about 1 millisecond to about 12 milliseconds, an interval of 3 to 4 milliseconds being typically utilized in practice. The timing signal at line 482 as coupled to the $\overline{Q}$ terminal of device 476 is directed to the output enabling, OE, terminal of an 8-bit latch 484 and functions to enable the Q1–Q8 outputs thereof for the interval derived by network 474. During this same output, a light emitting diode, D20 coupled between the Q terminal of device 476 and ground is illuminated to provide a visual indication that the components receiving logic inputs from logic control 454 are active. Latch 484 may be provided, for example, as a type 74LS374 and the input terminals thereof at 1D–8D are seen coupled to the logic inputs at terminals D0–D7. Solenoid valve selection data as submitted via line array 486 are transferred to the Q outputs of device 484 upon the occurrence of a clock input from line 488 extending from the Y1 terminal of decoder 470. Resulting actuation outputs at select ones of terminals Q1–Q8 of device 484 at line array 490 are submitted as the output of the input circuitry 452. Line array 490 is seen extending to an array of jumpers 492 which permit the use of the circuitry 450 for actuating the solenoid actuated solvent valve assembly as described earlier at 152. For this purpose, an additional timer network 494 is provided including a monostable multivibrator 496 which may be identical to that at 476. Device 496 is configured having a fixed maximum output interval at line 498 derived by selection of the values of capacitor C11 and resistor R32. As before, a diode D21 coupled to the Q output of device 496 illuminates in the presence of a timing interval. Both devices 496 and 476 may be reset from the software of the system by inputs from lines 500 and 502. Control from logic control 454 to the device 496 is derived from the Y3 output of latch 470 at line 504 which extends, in turn, to the B in put terminal thereof.

Line 498 extends, as before, to the output enabling, OE, terminal of an 8-bit latch 506 which is identical to that at 484. The 1D–8D terminals thereof are coupled by line array 508 to array 486, while the corresponding outputs of the latch at array 510 are coupled to jumper array 492. Thus, the device 506 may be employed under the control of timing network 494 for operation of the system in conjunction with a solvent valve. The selected solvent or ink actuating outputs as are directed through jumper array 492 are provided at line array 512 which, in turn, extend to an energization control network represented in general in FIG. 13B at 514. Network 514 is comprised of eight identically structured solenoid driver networks 516–523. Inasmuch as these networks 516–523 are identical, only that at 516 is illustrated in detail, the remaining networks 517–523 being represented in block schematic form.

The actuation outputs at line array 512 as represented in FIG. 13A are low true and are directed, as represented by array lines **512*a*–512*h* and connector leads 528*a*–528*h* to inputs of respective networks 516–523. Looking specifically to network 516, as represented at FIG. 13B, connector lead 528*a* is seen to be directed to the cathode input of the photodiode of an opto-isolator or opto-coupler 530. As before, device 530 may be provided as a type H11F2 and, similarly, the anode terminal of the diode component thereof is coupled to +5v from line 532*a* extending, in turn, to one resistor of a pull-up resistor array 534 connected, in turn to +5v. Line 532*a* is one of an array 532 shown comprised of leads 532*a*–532*h* extending to respective networks 516–523**.

The outputs of device 530 are at line 533 extending to +12v supply and line 534. Looking in particular to FIG. 13B, line 534 is seen extending to the gate of a solid-state switch or power transistor Q3. Transistor Q3 may be identical to that described at Q1 in connection with FIG. 10B. The source of transistor Q3 is coupled to ground via line 536, while the drain terminal thereof, containing an isolation diode D22, is coupled to line **538*a* of the line array 538*a*–538*h* represented generally at 538. A turn-off resistor R33 is seen coupled between lines 534 and 536. Thus, upon the impression of an actuating signal from line 534 to the gate of transistor Q3, line 538*a* is activated. It may be observed at the solenoid or energization winding connector represented at block 540 that line 538*a* extends to one side of the winding of a first solenoid identified as "SOL 1". Each energization winding of the array of solenoids is coupled such that one side thereof is connected to +24v as represented at terminal 1 and so labelled, and the other side is coupled to one of the terminals 4–11. Thus, line 538 couples a winding in the manner shown schematically at 58*a*'. Upon the turning on of transistor Q3, line 538*a* is coupled to ground to impress the noted +24v across the coil as at 58*a*'** through isolation diode D22.

Line **512*a* from the array 512 carrying actuation outputs also is seen to be coupled to the B terminal input of a monostable multivibrator 542. Device 542 may, for example, be a type 4538 and functions as a timer providing an output of duration determined by the values of capacitor C12 and resistor R34. A pull-up resistor R35 is seen coupled between +5v and line 512*a*. Thus, simultaneously with the activation of opto-coupler 530 and turning on of transistor Q3, device 542 is actuated to, in turn, generate a low true signal at line 544 which is further developed at driver 546 to be impressed via line 548 at the cathode of the photodiode of an opto-coupler 550. The anode of the photodiode of device 550 is coupled through resistor R36 to +5v and the output thereof at line 552 is seen coupled to the gate of solid-state switch or power transistor Q4 which may be structured identically as transistor Q3. The drain terminal of transistor Q4 is coupled with line 538*a* in common with that of transistor Q3, while the source thereof is coupled to line 554. Line 554 is similarly coupled to corresponding power transistors in each of the networks 517–523 and is seen to extend to terminal 12 of terminal block 540 and is coupled to a −48v source. A turn-off resistor R37 is seen coupled between gate line 552 and line 554**.

Line 552 serves to impose a −36v gating input signal to transistor Q4. In this regard, it may be observed that the opposite output line from opto-coupler 550 at line 556 is coupled with each of the corresponding opto-couplers of networks 517 and 523 and extends through resistor R38 to ground. Line 556 additionally is coupled to line 554 through diode D23 and capacitor C13.

With the arrangement shown, transistors Q3 and Q4 turn fully on simultaneously and transistor Q4 is turned off only after an interval, for example about 0.6 milliseconds, as determined by timing device 542. Isolation diode D22 isolates the source terminal of transistor Q3 and thus, in effect, a +24v is at one side of the excitation winding involved and −48v is at the other side of the winding. The interval of excitation at this larger potential difference is selected as being adequate to fully open the solenoid valve associated with the energization winding. A fuse as at F2 is shown coupled within line 538*a* and a metal oxide varister (MOV 558) is coupled between line 538*a* and +24v for voltage suppression purposes. As noted above, because of the continued presence of +24v from transistor Q3, no inductive spike results from the turning off of transistor Q4. That inductive spike which does result from the turning off of transistor Q3 at the end of the total excitation interval is of a manageable level. As in the earlier embodiment, with the instant circuit, the power transistors Q3 and Q4 are turned fully on essentially instantaneously and thus there is a dismissible amount of heat generation. Further, the rapid response evolves a highly efficient opening and closing of the solenoid actuated valves.

A light emitting D24 and resistor R39 are seen coupled intermediate ground and the drain terminal of transistor Q3. This diode functions to indicate that the fuse at F2 is intact. Similarly, FIG. 13B reveals a light emitting diode D25 and resistor R40 coupled between +5v and line 512*a*. With such an arrangement, the diode D25 is illuminated at such time as an actuating signal is impressed upon line 512*a* to indicate that that particular channel is being driven. Each of the networks 516–523 incorporates such a diode as at D25 for this purpose.

Since certain changes may be made in the above-described apparatus and method without departing from the scope of the invention herein involved, it is intended that all matter contained in the description thereof or shown in the accompanying drawings shall be interpreted as illustrative and not in a limiting sense.

We claim:

1. A marker assembly actuable for spray marking a surface with marking fluid, comprising:

a housing extending from a front surface to a rearward portion;

a channel within said housing having a given axis and extending from said front surface to said rearward portion;

a sleeve fixed within said channel and extending into said rearward portion coil retaining cavity;

an excitation coil positioned over said sleeve at said rearward portion;

a pole piece fixed within said sleeve and having a forward surface located a predetermined distance from said front surface;

a fluid cap removably mounted upon said housing front surface and having a passageway coaxial with said given axis extending to an opening within a valve seat;

a valve stem having a tip seatable in closing relationship against said valve seat, said stem being reciprocally movable and extending within said channel and said sleeve to an armature retaining portion;

a spring within said channel for bearing said valve stem into said closing relationship;

an armature fixed to said valve stem armature retaining portion, slideably movable therewith within said sleeve and having a rearwardly disposed surface positioned a predetermied fixed gap distance from said pole piece forward surface when said valve stem is positioned in said closing relationship;

a fluid input for supplying said fluid to said chamber frame fluid supply;

control means for selectively energizing said excitation coil to effect retraction of said armature to the extent of said fixed gap.

2. The marker assembly of claim 1 including a coil retaining cavity within said housing at said rearward portion and disposed substantially symmetrically about said channel given axis for receiving said excitation coil.

3. The marker assembly of claim 2 in which:

said sleeve extends from said channel into said coil retaining cavity; and including a cylindrical frame formed of magnetic material and positioned within said coil retaining cavity about said excitation coil and forming a component of a magnetic circuit.

4. The marker assembly of claim 3 including first and second end plates positioned within said coil retaining cavity, symmetrically disposed about said given axis, formed of magnetic material and positioned at oppositely disposed ends of said excitation coil.

5. The marker assembly of claim 1 in which:

said housing is configured having an elongate said front surface;

a plurality of said channels are located within said housing wherein the said given axis of each is arranged in regularly spaced mutually parallel relationship, each said channel being operatively associated with a said sleeve, a said excitation coil, a said pole piece, a said fluid cap, a said valve stem, a said spring, and a said armature; and said fluid input comprises a manifold duct connectable with said fluid supply, extending within said housing transversely to said plurality of channels and in fluid communication with each said channel of said plurality thereof.

6. The marker assembly of claim 5 in which:

each said fluid cap operatively associated with each said channel of said plurality of channels includes an air conveying channel; and said housing includes an air channel connectable with a source of gas under pressure, extending within said housing transversely to said plurlity of channels and in fluid communication with each said fluid cap air conveying channel.

7. The marker assembly of claim 5 including a solvent valve assembly comprising:

a solvent channel within said housing;

a solvent valve seat within said solvent channel having a port;

a valve stem assembly within said solvent channel having a tip seatable in port closing relationship with said solvent valve seat and actuable to retract said tip from said solvent valve seat;

a solenoid drive energizable to actuate said valve stem assembly;

a first solvent conduit connectable with a supply of solvent fluid and coupled in fluid supply communication with said solvent channel for supply of said solvent fluid thereto; and a second solvent conduit coupled in fluid communication between said solvent valve seat opening and said air channel.

8. The marker assembly of claim 1 in which:

said fluid cap valve seat has a surface which is generally conically configured of given apex angle; and said valve stem tip is configured having a forwardmost positioned conical seating tip of apex angle corresponding with said given apex angle nestable in seating relationship with said valve seat surface, and having a next adjacent region configured to be spaced from said valve seat surface in non-contacting relationship, and includes a rearward conical seating surface nestable in seating relationship with said cap valve seat surface simultaneously with the said seating of said forwardmost positioned conical seating tip.

9. The marker assembly of claim 1 in which said control means is responsive to carry out the energization of said excitation coil between on and off states in accordance with logic inputs and comprises:

receiving means for receiving said logic inputs and having a corresponding actuation output for a duration selectable by the activation thereof;

a timer responsive to said logic inputs and deriving a said receiving means activation for a selectively adjustable interval of time;

a source of power having a voltage level selected as effective to enhance the rate of current development within said excitation coil;

a first solid state power switch connectable in current switching relationship between said source of power and said excitation coil responsive to a switch input to derive a conductive state effecting the application of said source of power to said excitation coil and responsive to the removal of said switch input to terminate said application; and a current control network coupled with said solid state power switch and responsive to said actuation output to have a said control network deriving said switch input during said on-state and including a current monitor network for effecting said switch input removal during said on-state when said current development witin said excitation winding exceeds a predetermined value, and responsive to said removal of said actuation output to remove said switch input and assume a said off-state.

10. The marker assembly of claim 9 including a dynamic clamping network, comprising:

a second solid state switch coupled in switching relationship between said excitation coil and ground at a location intermediate said excitation coil and said first solid state switch and switchable into a conductive state in response to a clamp signal; and a voltage monitoring network responsive to counter EMF generated within said excitation coil upon removal of said switch input of said first solid state switch, for switching said second solid state switch to remove said counter EMF from said excitation coil upon its reading a predetermined voltage level.

11. The method for forming a marker assembly for spray marking a surface with marking fluid comprising the steps of:

providing a housing extending from a front surface representing a first datum plane to a rearward portion;

forming a channel within said housing extending normally from said front surface;

providing a pole piece having a forward surface representing a second datum plane;

fixing said pole piece within said channel at said housing rearward portion at a location wherein said second datum plane is a fixed, predetermined distance from said first datum plane;

providing an excitation winding;

mounting said excitation winding upon said housing over and in magnetic flux transfer association with said pole piece;

providing a fluid cap threadably mountable upon said housing in seated relationship at said front surface in operative communication and alignment with said channel, said cap having a passageway extending to an opening located at a valve seat;

providing a valve stem having a tip seatable in closing relationship against said valve seat and extending to an armature retaining position;

providing an armature configured for slideable movement within said channel having a rearwardly disposed surface and an oppositely disposed receiving portion for receiving said valve stem retaining portion;

providing a stem assembly jig having a cap mounting surface representing a third datum plane corresponding with said first datum plane and having an opening extending therethrough for removably receiving said fluid cap in seated relationship and having a first locator component including a first reference surface representing a fourth datum plane aligned with and spaced from said third datum plane a mounting distance representing the distance between said first datum plane and said second datum plane less a predetermined gap distance;

mounting said fluid cap upon said assembly jig opening in seated relationship with said cap mounting surface;

positioning said valve stem tip in said closing relationship against said valve seat;

inserting said armature retaining portion of said valve stem within said armature receiving portion;

positioning said armature rearwardly disposed surface against said first locator component first reference surface;

then fixing said armature retaining portion of said valve stem to said armature receiving portion of said armature while positioned within said stem assembly jig to provide a valve stem-armature assembly;

providing a spring for biasing said valve stem tip into seated closing engagement with said valve seat;

inserting said spring and said valve stem-armature assembly within said channel; and mounting said fluid cap in seating relationship upon said housing at said first surface in operative communication and alignment with said channel.

12. The method of claim 11 including the steps of:

providing a hollow sleeve having a forwardly disposed surface;

providing a sleeve assembly jig having a seating surface and a second locator component including a second reference surface extending normally a predetermined distance from said seating surface;

positioning said sleeve over said second locator component in a manner wherein said forwardly disposed surface abuttably engages said seating surface;

positioning said pole piece within said sleeve in a manner wherein said forward surface thereof is in abutting engagement with said second reference surface;

then fixing said pole piece to said sleeve to provide a pole piece-sleeve assembly; and carrying out said step of fixing said pole piece within said channel by positioning and fixing said pole piece-sleeve assembly within said channel.

13. The method of claim 11 in which:

said spring is positioned over said valve stem intermediate said valve stem tip and said armature prior to said step positioning said armature rearwardly disposed surface against said first locator component first reference surface.

14. A control system for carrying out the energization of the excitation winding of a solenoid driven valve actuable between on and off-states to effect a dot image forming dispersion of marker fluid in accordance with logic inputs comprising:

receiving means for receiving said logic inputs and having a corresponding actuation output for a duration selectable by the activation thereof;

a timer responsive to said logic inputs and deriving a said receiving means activation for a selectively adjustable interval of time;

a source of power having a voltage level selected as effective to enhance the rate of current development within said excitation winding to derive an efficient said on-state actuation of said valve;

a first solid state power switch connectable in current switching relationship between said source of power and said excitation winding, responsive to a switch input to derive a conductive state effecting the application of said source of power to said excitation winding and responsive to the removal of said switch input to terminate said application; and a current control network coupled with said solid state power switch and responsive to said actuation output to derive said on-state, said control network deriving said switch input during said on-state and including a current monitor network for effecting said switch input removal during said on-state when said current development within said excitation winding exceeds a predetermined value, and responsive to said removal of said actuation output to remove said switch input and assume said off state.

15. The control system of claim 14 including a dynamic clamping network, comprising:

a second solid state switch coupled in switching relationship between said excitation winding and ground at a location intermediate said excitation winding and said first solid state switch and switchable into a conductive state in response to a clamp signal; and a voltage monitoring network responsive to counter EMF generated within said excitation winding upon removal of said switch input of said first solid state switch, for switching said second solid state switch to remove said counter EMF from said excitation winding upon its reaching a predetermined voltage level effective to derive an efficient said off state actuation of said valve.

16. The control system of claim 14 in which:

said receiving means includes a latch having an input coupled for receiving said logic input and an output for providing said actuation output upon said activation thereof by receipt of an enable input; and said timer comprises an R-C timing network including a manually adjustable resistance for deriving said enable input for said selectable duration.

17. The control system of claim 16 including first visually perceptible indicator means responsive to said enable input for providing a visually perceptible output.

18. The control system of claim 14 in which said source of power is selected having a voltage of about 90 volts.

19. The control system of claim 14 in which said current control network includes an oscillator network having a clock output of predetermined frequency, said control network being responsive to said clock output during said on-state subsequent to said switch input removal to re-derive said switch input to effect said first solid state switch conductive condition.

20. The control system of claim 14 in which said current control network includes:

multivibrator means having a first input for receiving said actuation output and exhibiting said on-state in the presence thereof and said off-state in the absence thereof, a reset input, a clock input and an output coupled with said first solid state switch for conveying said switch input thereto;

said current monitor network includes comparator means having an output coupled with said reset input, a reference input and a monitor input, monitoring impedance means coupled with said monitor input and responsive to said current development within said excitation winding for deriving a monitor signal corresponding therewith and a reference network for deriving a predetermined reference signal; said comparator means deriving a reset signal at said output when said monitor signal exceeds said reference signal for resetting said multivibrator means to terminate said switch input conveyance, and for subsequently conveying said switch input to said first solid state switch during said on-state upon the occurrence of a clock signal at said clock input; and oscillator means coupled with said clock input for deriving said clock signal at a predetermined frequency.

21. The control system of claim 20 in which said predetermined clock frequency is about 33 kilohertz.

22. The control system of claim 20 including second visually perceptible indicator means coupled with said comparator means output and generating a visual output in response to said reset signal.

23. A driver circuit for carrying out the energization of the excitation winding of a solenoid actuated valve in response to an actuation output comprising:

a source of power having a voltage level selected as effective to enhance the rate of current development within said excitation winding;

a first solid state switch connectable in current switching relationship between said source of power and said excitation winding, responsive to a switch input to derive a conductive state effecting the application of said source of power to said excitation winding and responsive to the removal of said switch input to terminate said application; and a current control network coupled with said first solid state switch and responsive to said actuation output to have an on-state, said control network deriving said switch input during said on-state, including a current monitor network for effecting said switch input removal during said on-state when said current development within said excitation winding exceeds a predetermined value, and including a regeneration network for effecting re-derivation of said switch input during said on-state when said current development returns to a value below said predetermined value, said control network being responsive to said removal of said actuation output to remove said switch input to assume an off-state.

24. The driver circuit of claim 23 in which said source of power is selected having a voltage of about 90 volts.

25. The driver circuit of claim 23 in which said regenerator network includes an osicillator network having a clock output of predetermined frequency, said control network being responsive to said clock output during said on-state subsequent to said switch input removal to re-derive said switch input to effect said first solid state switch conductive condition.

26. The driver circuit of claim 23 in which said current control network includes:

multivibrator means having a first input for receiving said actuation output and exhibiting said on-state in the presence thereof and said off-state in the absence thereof, a reset input, a clock input and an output coupled with said first solid state switch for conveying said switch input thereto;

said current monitor network includes comparator means having an output coupled with a said reset input reference input and a monitoring output, monitoring impedance means coupled with said monitor input and responsive to said current development within said excitation winding for deriving a monitor signal corresponding therwith and a reference network for deriving a predetermined reference signal, said comparator means deriving a reset signal at said output when said monitor signal exceeds said reference signal for resetting said multivibrator means to terminate said switch input conveyance, and for subsequently conveying said switch input to said first solid state switch during said on-state upon the occurrence of a clock signal at said clock input; and said regenerator network includes oscillator means coupled with said clock input for deriving said clock signal at a predetermined frequency.

27. The driver circuit of claim 26 in which said predetermined clock frequency is about 33 kilohertz.

28. The driver circuit of claim 26 including second visually perceptible indicator means coupled with said comparator means output and generating a visual output in response to said reset signal.

29. The driver circuit of claim 23 including a dynamic clamping network, comprising:

second solid state switch coupled in switching relationship between said excitation winding and ground at a location intermediate said excitation winding and said first solid state switch and switchable into a conductive state in response to a clamp signal; and a voltage monitoring network responsive to counter EMF generated within said excitation winding upon removal of said switch input of said first solid state switch, for switching said second solid state switch to remove said counter EMF from said excitation winding upon its reaching a predetermined voltage level effective to derive an efficient said off state actuation of said valve.

30. A driver circuit for carrying out the energization of the excitation winding of a solenoid actuated valve in response to an actuation output, comprising:

a first source of power having a voltage level of first polarity selected as effective to enhance the rate of current development within said excitation winding;

a second source of power having a voltage level less than that of said first source of power and of second polarity;

first solid-state switch means actuable between off and on states for applying said first source of power across said winding;

second solid-state switch means actuable between off and on states for applying said second source of power across said winding; and control means responsive to said actuation output for simultaneously actuating said first and second solid-state switch means to said on state and for subsequently activating said first solid-state switch means to said off state following an interval selected for enhancing the rate of current build-up within said excitation winding.

31. The circuit of claim 30 in which said control means includes unidirectionally conducting isolation means intermediate said first and second solid-state switches for isolating said second solid-state switch from said first source of power when said first solid-state switch is in said on state.

32. A control system for carrying out the energization of the excitation winding of a solenoid driven valve actuable between on and off-states to effect a dot image forming dispersion of marker fluid in accordance with logic inputs comprising:

input means responsive to said logic inputs for providing an activation output for a predetermined interval;

a first source of power having a voltage level of first polarity selected as effective to enhance the rate of current development within said excitation winding to derive an efficient on-state actuation of said valve;

a second source of power having a voltage level less than that of said first source of power and of second polarity;

first solid-state switch means actuable between off and on states for impressing said first source of power across said winding;

second solid-state switch means actuable between on and off states for impressing said second source of power across said winding in potential enhancing complement with said first source of power; and control means responsive to said actuation output for simultaneously actuating said first and second solid-state switch means to said on state and for subsequently actuating said first solid-state switch means to said off state following an interval selected for enhancing the rate of current build-up within said excitation winding.

33. The circuit of claim 32 in which said control means includes unidirectionally conducting isolation means intermediate said first and second solid-state switches for isolating said second solid-state switch from said first source of power when said first solid-state switch is in said on state.

34. The circuit of claim 32 in which said input means comprises:

receiving means for receiving said logic inputs and having a corresponding actuation output for a duration selectable by the activation thereof;

a timer responsive to said logic inputs and deriving a said receiving means activation for a selectively adjustable interval of time.

* * * * *